US005342740A

United States Patent [19]

Goto et al.

[11] Patent Number: 5,342,740

[45] Date of Patent: Aug. 30, 1994

[54] METHOD OF PROCESSING SILVER HALIDE COLOR PHOTOGRAPHIC MATERIAL

[75] Inventors: Masatoshi Goto; Takatoshi Ishikawa, both of Kanagawa, Japan

[73] Assignee: Fuji Photo Film Co., Ltd., Kanagawa, Japan

[21] Appl. No.: 769,684

[22] Filed: Oct. 2, 1991

[30] Foreign Application Priority Data

Oct. 2, 1990 [JP] Japan ..... 2-264451

[51] Int. Cl.[5] ..... G03C 7/46; G03C 7/00; G03C 5/38

[52] U.S. Cl. ..... 430/393; 430/376; 430/384; 430/385; 430/400

[58] Field of Search ..... 430/376, 384, 385, 393, 430/400

[56] References Cited

U.S. PATENT DOCUMENTS

| | | | |
|---|---|---|---|
| 5,055,384 | 10/1991 | Kühnert | 430/393 |
| 5,063,142 | 11/1991 | Ishikawa | 430/400 |
| 5,139,929 | 8/1992 | Ishikawa et al. | 430/400 |

FOREIGN PATENT DOCUMENTS

| | | | |
|---|---|---|---|
| 0243096 | 10/1987 | European Pat. Off. . | |
| 0289008 | 11/1988 | European Pat. Off. . | |
| 0399434 | 11/1990 | European Pat. Off. . | |
| 0409276 | 1/1991 | European Pat. Off. . | |
| 55-79446 | 6/1980 | Japan | 430/400 |
| 1405948 | 9/1975 | United Kingdom . | |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A method of processing an imagewise exposed silver halide color photographic material is disclosed, wherein the photographic material comprises a support having thereon a photosensitive silver halide emulsion layer containing a silver halide emulsion having a silver chloride content of at least 80 mol %. The processing method comprises the steps of color developing the photographic material in a color developing solution, and then bleach-fixing in a bleach-fixing solution, further comprising replenishing the bleach-fixing solution as the photographic material is processed by adding thereto a regenerated bleach-fixing replenisher and collecting the resulting overflow solution from the bleach-fixing tank, the regenerated bleach-fixing replenisher comprising a regenerating agent and the overflow solution from the bleach-fixing tank, and wherein the solids content of the regenerating agent is at least 70 wt % of the total weight of the regenerating agent. In accordance with the present method, repeated reuse of the used bleach-fixing solution as a replenisher is achieved without adversely affecting the desilvering property and color reproducibility of the processing solution. Processing of a photographic material having a high silver chloride content photosensitive silver halide emulsion layer in accordance with the present method provides excellent photographic images having good storage stability.

15 Claims, No Drawings

METHOD OF PROCESSING SILVER HALIDE COLOR PHOTOGRAPHIC MATERIAL

FIELD OF THE INVENTION

The present invention relates to a method of processing a silver halide color photographic material and, in particular, to a method for continuous processing in which the used bleach-fixing solution is re-used as a replenisher to reduce the amount of the waste liquid to be drained from the processing system, and also to reduce operating costs.

BACKGROUND OF THE INVENTION

In a method of processing a silver halide color photographic material, in general, the used processing solutions are drained as overflow wastes.

However, such used processing solutions to be recovered or drained as overflow wastes have high environmental pollution load values. In addition, it is expensive to recover and collect the waste solutions. On the other hand, if the used processing solutions (overflow liquids) could be re-used as replenishers to the processing system, the above problem could be solved and, additionally, the active components remaining in the overflow liquids could also be re-used. As a result, the amount of chemicals needed for producing fresh replenishers could be reduced to thereby reduce processing costs. Accordingly, various techniques of recovering and regenerating used processing solutions have heretofore been studied in this technical field. For example, the fluctuation in the concentration of the components in the used processing solution as recovered is compensated in such a way that the compensated solution can be re-used as a replenisher. For the compensation, in general, accumulated components which would adversely affect the photographic properties of the material to be processed are removed, while the consumed active components are supplemented, such that the thus compensated solution may be re-used as a replenisher.

Various investigations have been made of such regenerating techniques for a bleach-fixing solution for use in processing color photographic materials.

A bleach-fixing solution contains, in general, at least three chemicals each having a different function, including an aminopolycarboxylato/iron(III) complex as a bleaching agent, a thiocyanate as a fixing agent, and a sulfite as a preservative. The overflow from such a bleach-fixing solution contains, in addition to the three starting reagents, silver ion formed by desilvering the photographic material and color developer components carried over from the previous bath. Furthermore, the used bleach-fixing solution also contains an aminopolycarboxylato/iron(II) complex formed by oxidation of silver into silver ion.

As discussed above, the technique of regenerating the overflow from the used bleach-fixing solution generally includes removal of the harmful accumulated components and addition of consumed active components. In particular, the efficient removal or reduction of harmful accumulated components from the overflow is a problem. As a means of solving the problem, various regenerating methods have been proposed as discussed below, in which silver ion formed by desilvering is removed or reduced.

*Radiography,* 29, 256–259 (1963) and JP-A-48-3624 (the term "JP-A" as used herein means an "unexamined published Japanese patent application") illustrates a method of contacting a used bleach-fixing solution with metallic iron (e.g., steel wool), in which the silver ion is recovered as metallic silver by contact with the metallic iron, such that the silver ion concentration in the used bleach-fixing solution is reduced. In this method, however, the metallic iron dissolves into the solution as iron(II) ion having a strong reducing power. As a result, the oxidizing power of the bleach-fixing solution is lowered to often cause inadequate desilvering or color-reproducibility. If, in this method, the silver ion concentration is further lowered, the problem becomes more severe.

JP-A-50-98837, JP-A-51-19535 and JP-A-51-36136 and U.S. Pat. No. 4,014,764 propose a method of reducing and recovering silver ion by electrolysis. Also in this case, the existing iron(III) complex is reduced to the corresponding iron(II) complex, and the sulfite ion is oxidized to a sulfate ion at the anode to also cause inadequate desilvering and color reproducibility. In addition, the stability of the bleach-fixing solution is thereby lowered. The above noted problems become more severe when the current amount is increased to thereby increase the silver recovery percentage and lower the silver ion concentration in the bleach-fixing solution.

*J. Appl. Photogr. Eng.,* 6, 14–18 (1980) and *PMPTE J.,* 93, 800–807 (1987) mention a technique of adsorbing and removing the remaining silver complex by the use of an ion exchange resin. In accordance with this method, however, the adsorbed silver complex must be desorbed from the resin and the resin must be regenerated. For such desorption and regeneration, a complicated operation is necessary. In addition, a large amount of waste is drained from the process, and the operating cost is unsatisfactorily high.

JP-B-48-33697 (the term "JP-B" as used herein means an "examined Japanese patent publication") and JP-A-50-145231 propose a method of regenerating an overflow not by positively removing silver, but by reducing the relative amount of the equilibrated accumulation of silver ion by dilution. The method does not require any particular silver recovering device and recovery of silver for re-use is possible by this method. Therefore, the method is simple and inexpensive. In accordance with this method, however, silver halide eluted from the processed photographic material as well as sulfates accumulate in the processing solution. In particular, when a large amount of silver bromide is eluted, the accumulated halide and sulfate cause desilvering delay. In addition, because of the accumulation of developer components, the processed photographic material would have undesirable staining, and the color reproduction in the processed material would often be insufficient. Because of these reasons, the stability of photographic properties in continuous processing of this method is unsatisfactory.

In general, in the technique of regenerating and reusing the used processing solution by removing or reducing the concentration of harmful components in the used processing solution, it is difficult to finally control the proportion of the components in the regenerated solution. Therefore, there is an inevitable disadvantage in that the equipment for such regeneration is of large scale. Conventional methods of removing or reducing silver ion for re-use of the used bleach-fixing solution by the above-described prior art techniques were further found to have other additional disadvantages of the above-described desilvering and color reproducing insufficiency, in addition to control of the proportion of components in the regenerated solution.

Where a used bleach-fixing solution is regenerated and re-used, halide ion and silver ion accumulate, aminopolycarboxylato/iron(II) complexes accumulate, and additionally developer components and sulfates formed by oxidation of sulfite ion accumulate. The thus accumulated components can interact with each other in a complex manner to cause desilvering delay or leucoation of cyan dyes (as a result, insufficiency of color reproducibility). Such disadvantageous phenomena become pronounced in the case of rapid processing.

In a photographic laboratory, in general, plural processors are mostly used, and separate replenishers are generally applied to each of the processors. In this case, each of the processors is operated under different processing conditions (for example, with respect to the amount of the photographic material to be processed, the processing time, the processing temperature, etc.) and, as a result, the compositions of the respective tank solutions or the respective overflows are generally different from one another. In particular, the overflow from a first used bleach-fixing solution has different concentrations of preservative, silver ion and bleaching agent as compared to the overflow from a second processor. Where a plural number of such solutions is gathered and regenerated as a whole, the composition of the regenerated replenisher noticeably fluctuates. Because of such great fluctuation of the regenerated replenisher, the processed photographic material is undesirably stained (in the white background part), or desilvering of the processed photographic material is insufficient. Thus, the regeneration of overflows from plural tanks is much more difficult than the regeneration of one overflow from a single tank.

Because of the above reasons, regeneration of an overflow solution from a system of processing photographic materials is extremely difficult and, in particular, regeneration of an overflow solution from the bleach-fixing tank is most difficult.

SUMMARY OF THE INVENTION

A first object of the present invention is to provide a method of continuously processing a silver halide color photographic material, having good desilvering and color reproducibility, wherein the used bleach-fixing overflow solution is repeatedly re-used as a replenisher for the bleach-fixing bath.

A second object of the present invention is to provide a method of continuously processing a silver halide color photographic material, in which the amount of the waste liquid is reduced.

The objects of the present invention have been attained by a method of continuously processing an imagewise exposed silver halide color photographic material, said photographic material comprising a support having thereon at least one photosensitive silver halide emulsion layer containing a silver halide emulsion having a silver chloride content of at least 80 mol%, comprising the steps of color developing the photographic material in a color developing solution, and then bleach-fixing in a bleach-fixing solution, further comprising replenishing the bleach-fixing solution as the photographic material is processed by adding thereto a regenerated bleach-fixing replenisher and collecting the resulting overflow solution from the bleach-fixing tank, said regenerated bleach-fixing replenisher comprising a regenerating agent and the overflow solution from the bleach-fixing tank, and wherein the solids content of the regenerating agent is at least 70 wt % of the total weight of the regenerating agent.

DETAILED DESCRIPTION OF THE INVENTION

The present inventors have found that in a method of continuously processing a color photographic material, various components accumulate in large amounts with repeated regeneration and re-use of the used bleach-fixing solution to cause the various above-described problems of the prior art. Surprisingly, the present inventors have further discovered that these problems are effectively overcome by using a high silver chloride emulsion layer constituting the photographic material to be processed, and by specifically defining the proportion of the solid content of the regenerating agent to be added to the used bleach-fixing solution, without recovering silver ion by electrolysis which has conventionally been employed.

In accordance with the present invention, the color developer preferably does not substantially contain benzyl alcohol which is generally used as a development accelerator. In a preferred embodiment of the present invention, surprisingly, two or more overflows from two or more bleach-fixing tanks of two or more different processors can be regenerated at the same time to attain sufficiently good results, which is a highly important characteristic feature of the present invention.

Although not clear, it is considered that the amount of oxygen dissolved in the used bleach-fixing solution in the regenerating system is of such an extent as to accelerate decomposition of the sulfite ion in the solution. Additionally, excess oxygen similarly can cause the above-described problems together with other components accumulated in the used bleach-fixing solution.

If the developer contained benzyl alcohol, it would be carried over to the next bleach-fixing bath. As a result of regeneration of the used bleach-fixing solution from the bath containing benzyl alcohol, the benzyl alcohol would accumulate in the regenerated bleach-fixing solution. Thus, the repeated regeneration of the bleach-fixing solution would result in a high concentration of benzyl alcohol. Where the composition of the regenerated and re-used bleach-fixing solution fluctuates, an increase of stains in the processed photographic material as well as poor desilvering and color reproducibility during processing would be expected.

In accordance with the present invention, a more remarkable effect is attained when the regeneration percentage or the overflow utilization percentage is increased. This result is quite unexpected.

The regeneration percentage as referred to herein is represented by the following formula:

$$\text{Regeneration Percentage (\%)} = [(\text{Re-used Overflow Amount})/(\text{Overflow Amount})] \times 100$$

The method of the present invention is effective when the regeneration percentage is preferably 70% or more, more preferably 80% or more, especially preferably 90% or more. In accordance with the method of the present invention, therefore, the amount of the waste drained from an automatic processor is noticeably reduced and, additionally, fading of yellow dyes formed in the processed photographic material are almost completely inhibited even after storage of the processed material for a long period of time.

Further, in the method of the present invention, it is possible that two or more overflow solutions from two or more bleach-fixing tanks of two or more different processors are recovered, collected and mixed and a regenerating agent is added thereto to obtain the regenerated bleach-fixing replenisher. Also according to this embodiment, the amount of the waste can be noticeably reduced. In the two or more different processors, the processing amounts may be the same or different. For instance, in two processors, the processing amounts of photographic materials per unit hour may be different from each other at least three times, particularly at least five times. Thus, according to the method of the present invention, two or more overflow solutions from two or more bleach-fixing tanks of two or more different processors can be recovered and regenerated to attain sufficient good results.

A regenerating agent is added to the used bleach-fixing solution (overflow liquid) in accordance with the method of the present invention, which is explained in detail below.

The regenerating agent in the present invention is an additive to be added to the overflow solution for the purpose of re-using the bleach-fixing solution and comprises a solid substance, a liquid substance, an aqueous solution, etc.

The regenerating agent added to the bleach-fixing solution is preferably a solid substance. A solid substance as used herein is a substance that is a solid at room temperature. A powdery or granular solid substance is desirably used such that the substance is readily dissolved in the overflow from the bleach-fixing solution.

The proportion of the solid component in the regenerating agent to be added to the bleach-fixing solution in the present invention is preferably 70% by weight or more, more preferably 80% by weight or more, most preferably 100% by weight, of the total weight of the regenerating agent. If the regenerating agent contains an aqueous solution, the solute is treated as the solid component.

The regenerating agent added to the bleach-fixing solution in accordance with the method of the present invention can contain the compounds described below, which compounds are found in an ordinary bleach-fixing solution. Preferably, the compounds contained in the regenerating agent of the present invention are solid substances.

The oxidizing agent contained in the bleach-fixing solution (and regenerating agent) of the present invention is preferably an aminopoly-carboxylato/iron(III) complex. Examples of aminopolycarboxylic acids constituting these complexes include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid.

The aminopolycarboxylic compound may be in the form of a sodium, potassium, lithium or ammonium salt thereof, and an ammonium salt thereof is most preferred as providing the highest desilvering speed. Of these compounds, preferred compounds having a high bleaching power are iron(III) complexes of ethylenediaminetetraacetic acid, diethylenetriaminepentaacetic acid, cyclohexanediaminetetraacetic acid, 1,3-diaminopropanetetraacetic acid and methyliminodiacetic acid.

The ferric complex may be used in the form of the complex salts itself or, alternatively, as a ferric salt, such as ferric sulfate, ferric chloride, ferric nitrate, ferric ammonium sulfate or ferric phosphate, and a chelating agent such as an aminopolycarboxylic acid can be added to the bleach-fixing solution such that the intended ferric complex salt is formed in the solution. The chelating agent can be used in an excess amount exceeding the necessary amount for formation of the ferric complex salt. Of the iron complexes, aminopolycarboxylato/iron complexes are preferred. The amount of the bleaching agent to be added to the bleach-fixing solution is from 0.01 to 1.0 mol/liter, preferably from 0.05 to 0.50 mol/liter.

The bleach-fixing solution (and regenerating agent) for use in the present invention can contain various compounds as a bleaching accelerator. For example, the mercapto group-containing or disulfido group-containing compounds as described in U.S. Pat. No. 3,893,858, German Patent 1,290,812, JP-A-53-95630 and *Research Disclosure* No. 17129 (July, 1978), as well as the thiourea compounds as described in JP-B-45-8506, JP-A-52-20832 and JP-A-53-32735 and U.S. Pat. No. 3,706,561 are preferred for this purpose, as having an excellent bleaching power.

The fixing agent for use in the bleach-fixing solution (and regenerating agent) of the present invention may be a known fixing agent which is a water-soluble silver halide dissolving agent, and includes thiosulfates (e.g., sodium thiosulfate, ammonium thiosulfate); thiocyanates (e.g., sodium thiocyanate, ammonium thiocyanate); and thioether compounds and thiourea compounds (e.g., ethylene-bis-thioglycolic acid, 3,6-dithia-1,8-octanediol). The fixing agents can be used alone or in a combination of two or more. In the present invention, the use of thiosulfates, especially ammonium thiosulfate, is preferred. The amount of the fixing agent in the bleach-fixing solution is preferably from 0.1 to 2 mols, more preferably from 0.3 to 1.0 mol, per liter of the solution.

The bleach-fixing solution for use in the present invention can further contain various kinds of brightening agents, de-foaming agents and surfactants, as well as organic solvents such as polyvinyl pyrrolidone and methanol which are generally contained in known bleach-fixing solutions.

The bleach-fixing solution (and regenerating agent) for use in the present invention can contain, as a preservative, a sulfite ion-releasing compound, such as a sulfite (e.g., sodium sulfite, potassium sulfite, ammonium sulfite), bisulfite (e.g., ammonium bisulfite, sodium bisulfite, potassium bisulfite), and metabisulfite (e.g., potassium metabisulfite, sodium metabisulfite, ammonium metabisulfite). The sulfite ion-releasing compound can be added to the bleach-fixing solution in an amount of from about 0.02 to 0.50 mol/liter, more preferably from 0.04 to 0.40 mol/liter, in terms of sulfite ion.

The use of a carbonyl-bisulfite adduct as a preservative is preferred for the purpose of reducing the substantial sulfite ion concentration in the bleach-fixing solution, and for preventing the increase of sulfate ion formed from sulfite ion in the regenerated solution. Preferred carbonyl compounds for this purpose include acetaldehyde, acetone, nicotinaldehyde and benzaldehyde. The carbonyl compound may be added to the bleach-fixing solution separately from the sulfite or, alternatively may be added in the form of a carbonyl adduct to a sulfite.

The bleach-fixing solution for use in the present invention has a pH value of from 4 to 7, preferably from 5 to 6.75, in the processing tank. A pH value higher than this range disadvantageously results in inadequate desilvering, staining or processing unevenness. A pH value lower than the range causes inadequate color reproducibility or deterioration and contamination of the solution. The bleach-fixing time is preferably from 10 seconds to 60 seconds, more preferably from 20 seconds to 50 seconds, for attaining the effect of the present invention. If the processing time is too long, the effect of the present invention is unsatisfactory with respect to the desilvering property and color reproducibility. On the other hand, if the processing time is too short, there is a danger of inadequate desilvering.

In preparing a replenisher to the bleach-fixing solution of the present invention, chemicals consumed in the bleach-fixing reaction must be added to the overflow solution from the used bleach-fixing solution to prepare a regenerating agent. The consumed chemicals include, for example, the above-noted bleaching agent, fixing agent and preservative. Further, in the method according to the present invention, any components other than the regenerating agent should not be added to the overflow solution from the used bleach-fixing solution.

The regenerating agents are desirably added to the overflow in the form of ammonium salts thereof for the purpose of promoting good desilvering and color reproducibility. The ammonium ion content of the regenerating agent is preferably 75 mol % or more, more preferably 90 mol % or more, of the total cation content. Specific examples of the ammonium salt include ammonium ethylenediaminetetraacetato/iron(III), ammonium sulfite, ammonium bisulfite and ammonium thiosulfate. For the purpose of lowering the pH value of the regenerated solution, addition of an acid having a pKa value of from 2.0 to 6.0 thereto along with other various organic/inorganic acids is preferred. In particular, use of a carboxyl group-containing monobasic acid, such as acetic acid or glycolic acid, is preferred.

In the step of regeneration, if desired, aeration of the overflow or addition of an oxidizing agent (e.g., $H_2O_2$, persulfates) to the overflow may be effected, whereby the oxidizing power of the regenerated bleach-fixing solution is enhanced.

In accordance with the present invention, the used bleach-fixing solution (overflow) is pooled into a tank and a regenerating agent is added to the pooled overflow. The overflow is thus regenerated into a replenisher. The tank for pooling the overflow may be a replenisher tank from which the replenisher is added to the bleach-fixing solution. Alternatively, a regenerating agent may directly be added to the bleach-fixing bath. If desired, the undesirable components accumulated in the bleach-fixing tank may be removed from the tank intermittently after a determined period of time, for example, by the above-described known methods.

The amount of the replenisher to be introduced into the bleach-fixing solution during the bleach-fixing step is from 30 ml to 500 ml, preferably from 60 ml to 250 ml, per $m^2$ of the photographic material being processed.

As the replenisher for the bleach-fixing solution for use in the present invention, a conventional fresh replenisher may be used. It is preferred for the present invention that the regenerated bleach-fixing replenisher alone is used as the replenisher.

Next, the color developer for use in the method of the present invention is described in detail below.

The color developer for use in the present invention contains a p-phenylenediamine color developing agent. Specific nonlimiting examples of the color developing agent are indicated below.

D-1 N,N-diethyl-p-phenylenediamine
D-2 2-Amino-5-diethylaminotoluene
D-3 2-Amino-5-(N-ethyl-N-laurylamino)toluene
D-4 4-[N-ethyl-N-(β-hydroxyethyl)amino]aniline
D-5 2-Methyl-4-[-ethyl-N-(β-hydroxyethyl)amino]aniline
D-6 4-Amino-3-methyl-N-ethyl-N-[β-(methanesulfonamido)ethyl]-aniline
D-7 N-(2-amino-5-diethylaminophenylethyl)methanesulfonamide
D-8 N,N-dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline The p-phenylenediamine derivative may be in the form of a salt such as a sulfate, hydrochloride, sulfite or p-toluenesulfonate. The addition amount of the p-phenylenediamine color developing agent is from 0.1 g to 20 g, more preferably from 0.5 g to 10 g, per liter of the developer.

The color developer for use in the present invention preferably does not substantially contain a sulfite or a hydroxylamine salt, which is generally found in known color developers as a preservative. This is because the sulfite or hydroxylamine salt carried over to the post-bath containing a bleach-fixing solution reduces the oxidizing agent of an aminopolycarboxylato/iron(III) complex therein such that the oxidizing capacity of the bleach-fixing solution is lowered. Where the used bleach-fixing solution is regenerated and re-used, the reducing effect of the sulfite or hydroxylamine salt is more noticeable and, as a result adversely affects the desilvering property and color reproducibility of the regenerated bleach-fixing solution. The expression "substantially not containing a sulfite or hydroxylamine salt" as used herein means that the content of the compound in the color developer is $2.0\times10^{-3}$ mol/liter or less.

In order to overcome the problem, a hydroxylamine derivative or a hydrazine compound of the following formula (II) or (III) is preferably employed in place of the hydroxylamine salt.

$$HO—N(R^{11})(R^{12}) \quad (II)$$

In formula (II), $R^{11}$ and $R^{12}$ may be the same or different and each represents a hydrogen atom or an alkyl group, but both $R^{11}$ and $R^{12}$ must not be hydrogen at the same time.

The alkyl group represented by $R^{11}$ and $R^{12}$ may be substituted and has from 1 to 6 carbon atoms, preferably from 1 to 3 carbon atoms. Preferred substituents of the alkyl group include a hydroxyl group, an alkoxy group, a carboxylic acid group, a sulfonic acid group and a phosphonic acid group. Preferred examples of the hydroxylamine derivative represented by formula (II) are described below.

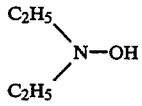
II-1

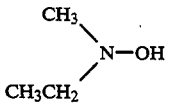
II-2

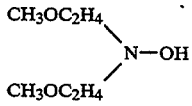
II-3

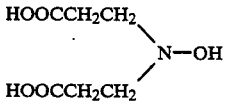
II-4

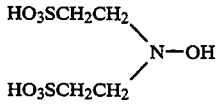
II-5

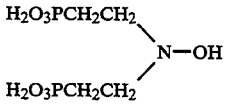
II-6

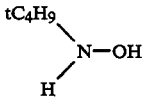
II-7

The compound of formula (II) may be added in the form of a salt with various acids. In addition, the compound of formula (II) may also be added in the form of a salt with various alkali metals or alkaline earth metals. A preferred amount of the compound represented by formula (II) to be added to the color developer for use in the present invention is from 0.2 g to 50 g, more preferably from 1.0 g to 10 g, per liter of color developer.

$$(R^1)(R^2)N—N(R^3)(X^1)_n—R^4 \quad \text{(III)}$$

In formula (III), $R^1$, $R^2$ and $R^3$ each represents a hydrogen atom, an alkyl group, an aryl group or a heterocyclic group;

$R^4$ represents a hydrogen atom, a hydroxyl group, a hydrazino group, an alkyl group, an aryl group, a heterocyclic group, an alkoxy group, an aryloxy group, a carbamoyl group or an amino group;

$X^1$ represents a divalent group; and n represents 0 or 1;

provided that when n is 0, $R^4$ is an alkyl group, an aryl group or a heterocyclic group; and $R^1$ and $R^2$ or $R^3$ and $R^4$ may be bonded together to form a heterocyclic ring.

Compounds of formula (III), which are hydrazine analogues including hydrazines and hydrazides, for use in the present invention are described in detail below.

$R^1$, $R^2$ and $R^3$ each represents a hydrogen atom, a substituted or unsubstituted alkyl group (preferably having from 1 to 20 carbon atoms, such as methyl, ethyl, sulfopropyl, carboxybutyl, hydroxyethyl, cyclohexyl, benzyl, phenethyl), a substituted or unsubstituted aryl group (preferably having from 6 to 20 carbon atoms, such as phenyl, 2,5-dimethoxyphenyl, 4-hydroxyphenyl, 2-carboxyphenyl), or a substituted or unsubstituted heterocyclic group (preferably having from 1 to 20 carbon atoms, and preferably being in the form of a 5-membered or 6-membered ring containing at least one hetero atom selected from oxygen, nitrogen and sulfur atoms, such as pyridin-4-yl, N-acetylpiperidin-4-yl).

$R^4$ represents a hydrogen atom, a hydroxyl group, a substituted or unsubstituted hydrazino group (e.g., hydrazino, methylhydrazino, phenylhydrazino), a substituted or unsubstituted alkyl group (preferably having from 1 to 20 carbon atoms, such as methyl, ethyl, sulfopropyl, carboxybutyl, hydroxyethyl, cyclohexyl, benzyl, t-butyl, n-octyl), a substituted or unsubstituted aryl group (preferably having from 6 to 20 carbon atoms, such as phenyl, 2,5-dimethoxyphenyl, 4-hydroxyphenyl, 2-carboxyphenyl, 4-sulfophenyl), a substituted or unsubstituted heterocyclic group (preferably having from 1 to 20 carbon atoms, and preferably being in the form of a 5-membered or 6-membered ring containing at least one hetero atom selected from oxygen, nitrogen and sulfur atoms, such as pyridin-4-yl, imidazolyl), a substituted or unsubstituted alkoxy group (preferably having from 1 to 20 carbon atoms, such as methoxy, ethoxy, methoxyethoxy, benzyloxy, cyclohexyloxy, octyloxy), a substituted or unsubstituted aryloxy group (preferably having from 6 to 20 carbon atoms, such as phenoxy, p-methoxyphenoxy, p-carboxyphenoxy, p-sulfophenoxy), a substituted or unsubstituted carbamoyl group (preferably having from 1 to 20 carbon atoms, such as unsubstituted carbamoyl, N,N-diethylcarbamoyl, phenylcarbamoyl), or a substituted or unsubstituted amino group (preferably having from 0 to 20 carbon atoms, such as amino, hydroxylamino, methylamino, hexylamino, methoxyethylamino, carboxyethylamino, sulfoethylamino, N-phenylamino, p-sulfophenylamino).

Substituents for the substituted groups represented by $R^1$, $R^2$, $R^3$ and $R^4$ preferably include a halogen atom (e.g., chlorine, bromine), a hydroxyl group, a carboxyl group, a sulfo group, an amino group, an alkoxy group, an amido group, a sulfonamido group, a carbamoyl group, a sulfamoyl group, an alkyl group, an aryl group, an aryloxy group, an alkylthio group, an arylthio group, a nitro group, a cyano group, a sulfonyl group, and a sulfinyl group. These substituents may be further substituted.

$X^1$ is a divalent group and examples thereof include —CO—, —$SO_2$—, or —C(=NH)—. n is 0 or 1. When n is 0, $R^4$ is a substituted or unsubstituted alkyl, aryl or a heterocyclic group. $R^1$ and $R^2$, or $R^3$ and $R^4$ may be bonded together to form a heterocyclic ring.

Where n is 0, at least one of $R^1$ to $R^4$ is preferably a substituted or unsubstituted alkyl group. Especially preferably, $R^1$, $R^2$, $R^3$ and $R^4$ each are a hydrogen atom, or a substituted or unsubstituted alkyl group, provided that all of $R^1$, $R^2$, $R^3$ and $R^4$ are not hydrogen atoms at the same time. In particular, more preferred is the case where $R^1$, $R^2$ and $R^3$ each are hydrogen atoms and $R^4$ is a substituted or unsubstituted alkyl group; the case where $R^1$ and $R^3$ each are hydrogen atoms, and $R^2$ and $R^4$ each are a substituted or unsubstituted alkyl group; and the case where $R^1$ and $R^2$ each are hydrogen atoms, and $R^3$ and $R^4$ each are a substituted or unsubstituted alkyl group or $R^3$ and $R^4$ are bonded together to form a heterocyclic ring.

Where n is 1, $X^1$ is preferably —CO—, $R^4$ is preferably a substituted or unsubstituted amino group, and $R^1$ to $R^3$ each are preferably a substituted or unsubstituted alkyl group.

The alkyl group represented by anyone of $R^1$ to $R^4$ preferably has from 1 to 20 carbon atoms, more preferably from 1 to 7 carbon atoms. Preferred substituents of the alkyl group include a hydroxyl group, a carboxylic acid group, a sulfone group and a phosphonic acid group. If the alkyl group has two or more substituents, they may be the same or different from one another.

Compounds of formula (III) may be in the form of dimers, trimers or higher polymers, where plural moieties derived from formula (III) are bonded to each other at $R^1$, $R^2$, $R^3$ and/or $R^4$.

Specific nonlimiting examples of compounds of formula (III) for use in the present invention are listed below.

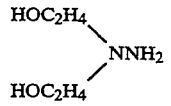
III-1

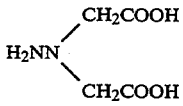
III-2

$HOOCCH_2NHNHCH_2COOH$ III-3

$H_2NNHCH_2CH_2CH_2SO_3H$ III-4

$H_2NNHCH_2CH_2SO_3H$ III-5

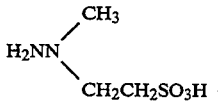
III-6

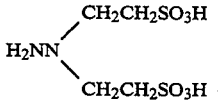
III-7

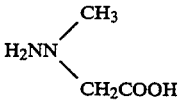
III-8

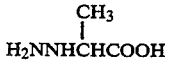
III-9

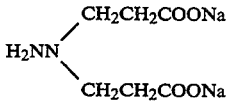
III-10

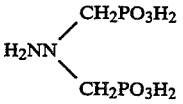
III-11

Other examples of compounds represented by formula (III) include the compounds described in U.S. Pat. No. 4,801,521 and European Patent Application No. 254294A.

Most of compounds of formula (III) are commercially available, or can be produced by known methods, for example, by the methods described in *Organic Syntheses*, Coll., Vol. 2, pp. 208–213; *Jour. Amer. Chem. Soc.*, (36), 1747 (1914); *Oil Chemistry*, (24), 31 (1975); *Jour. Org. Chem.*, (25), 44 (1960); *Journal of Chemicals*, (91), 1127 (1971); *Organic Synthesis*, Coll., Vol. 1, p. 450; *New Lecture of Experimental Chemistry*, Vol. 14, III, pp. 1621–1628 (published by Maruzen); *Beil.*, (2), 559; *Beil.*, (3), 117; E. B. Mohr et al., *Inorg. Syn.*, (4), 32 (1953); F. J. Wilson, & E. C. Pickering., *J. Chem. Soc.*, (123), 394 (1923); N. J. Leonard, & J. H. Boyer, *J. Org. Chem.*, (15), 42 (1950); *Organic Syntheses*, Coll., Vol. 5, p. 1055; P. A. S. Smith, *Derivatives of Hydrazine and Other Hydronitrogens Having N—N bonds*, pp. 120–124, pp. 130–131, THE BENJAMIN/CUMMINGS PUBLISHING COMPANY (1983); and Stanley R. Sandier, *Organic Functional Group Preparations*, Vol. 1, 2nd Ed., p. 457.

Hydrazines or hydrazides of formula (III) may be incorporated into the color developer for use in the present invention, in an amount of from 0.01 to 50 g, preferably from 0.1 to 30 g, more preferably from 0.5 to 10 g, per liter of color developer.

In addition, the color developer for use in the present invention may further contain various preservatives. Useful preservatives include triethanolamine, diethanolamine, catechol-3,5-disulfonate, and catechol-3,4,5-trisulfonate.

The color developer for use in the present invention preferably has a pH value of from 9 to 12, more preferably from 9 to 11.0. The color developer can contain various developer components of known compounds, in addition to the above-noted components.

In order to maintain the above-noted pH value range, various buffers are preferably added to the developer. Useful buffers include, for example, carbonates, phosphates, borates, tetraborates, hydroxybenzoates, glycine salts, N,N-dimethylglycine salts, leucine salts, norleucine salts, guanine salts, 3,4-dihydroxy-phenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates are preferred, as having a high solubility and an excellent buffering ability in the pH range of 9.0 or higher. In addition, these buffers are advantageous in that they do not adversely affect the photographic performance (e.g., fog) of the developer when they are added to the developer, and are inexpensive. Accordingly, these buffers are preferably employed.

Specific nonlimiting examples of the buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxy-benzoate (potassium 5-sulfosalicylate).

The amount of the buffer added to the color developer is preferably 0.1 mol/liter or more, especially preferably from 0.1 mol/liter to 0.4 mol/liter.

In addition, the color developer may further contain various chelating agents for preventing precipitation of calcium or magnesium, or for improving the stability of the color developer.

Nonlimiting examples of useful chelating agents include nitrilo-triacetic acid, diethylenetriaminepentaacetic acid, ethylenediamine-tetraacetic acid, triethylenetetramine-hexaacetic acid, N,N,N-trimethylenephosphonic acid, ethylenediamine-N,N,N',N'-tetramethylenephosphonic acid, 1,3-diamino-2-propanoltetraacetic acid, trans-cyclohexanediamine-tetraacetic acid, nitrilo-tripropionic acid, 1,2-diaminopropane-tetraacetic acid, hydroxyethyliminodiacetic acid, glycol ether diaminetetraacetic acid, hydroxyethylenediaminetriacetic acid, ethylenediamine-orthohydroxyphenylacetic acid, 2-phosphono-butane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

The chelating agents can be used alone or in a combination of two or more, if desired.

The amount of the chelating agent to be added to the color developer is such that it is sufficient for sequestering the metal ions in the color developer. For example, the addition amount is from about 0.1 g/liter to 10 g/liter of the color developer.

The color developer for use in the present invention may contain any development accelerator, if desired.

Examples of useful development accelerators include the thioether compounds described in JP-B-37-16088, JP-B-37-5987, JP-B-38-7826, JP-B-44-12380, JP-B-45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; p-aminophenols described in U.S. Pat. Nos. 2,610,122 and 4,119,462; amine compounds described in U.S. Pat. Nos. 2,494,903, 3,128,182, 4,230,796, 3,253,919, JP-B-41-11431, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; as well as other 1-phenyl-3-pyrazolidones, hydrazines, iso-ionic compounds, ionic compounds and imidazoles.

It is preferred that the color developer for use in the present invention substantially does not contain benzyl alcohol. The terminology "substantially does not contain benzyl alcohol" as used herein means that the color developer contains benzyl alcohol in an amount of 2.0 ml or less per liter of color developer or more preferably contains no benzyl alcohol. By excluding benzyl alcohol from the color developer, benzyl alcohol does not accumulate in the used bleach-fixing solution due to carry-over during continuous processing such that color reproduction failure, staining of the processed material and processing unevenness are prevented. Accordingly, a more favorable result may be obtained.

If desired, any antifoggant may be added to the color developer, in addition to a halide ion such as chloride or bromide ion. Alkali metal halides such as potassium iodide as well as organic antifoggants can be used, for example, as an antifoggant. Examples of useful organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolidine and adenine.

The color developer for use in the present invention preferably contains a brightening agent. The brightening agent is preferably a 4,4'-diamino-2,2'-disulfostilbene compound. The amount of the brightening agent added to the color developer is up to 10 g/liter, preferably from 0.1 g/liter to 6 g/liter.

If desired, the color developer for use in the present invention may further contain various surfactants such as alkylsulfonic acids, arylphosphonic acids, aliphatic carboxylic acids and aromatic carboxylic acids.

The processing time with the color developer is from 10 seconds to 120 seconds, preferably from 20 seconds to 60 seconds, for effectively attaining the effects of the present invention. The processing temperature may be from 33° to 45° C., preferably from 35° to 40° C.

In effecting continuous processing, the amount of the replenisher to the color developer is from 20 to 220 ml, especially preferably from 40 to 140 ml, per $m^2$ of the photographic material being processed, in order to achieve the effects of the present invention.

In addition, the color developer for use in the present invention may further contain a fungicide, if desired.

After desilvering by bleach-fixation, the silver halide color photographic material of the present invention is generally rinsed in water and/or stabilized.

The amount of the wash water for use in the rinsing step varies, depending upon the characteristics of the photographic material being processed (for example, the constituent components such as couplers, etc.), the application of the material, the amount of the rinsing water, the number of the rinsing baths (the number of rinsing stages), the replenishment system of normal current or countercurrent, and other various conditions, and therefore may be defined in a broad range. For instance, the relation between the number of the rinsing tanks and the amount of the rinsing water in a multi-stage countercurrent rinsing system may be obtained by the method described in *Journal of the Society of Motion Picture and Television Engineering*, Vol. 64, pages 248 to 253 (May, 1955).

In accordance with the multi-stage countercurrent rinsing system described in the above-noted literature, the amount of the rinsing water to be used may be considerably reduced. However, by reducing the amount of rinsing water, bacteria propagate in the rinsing tanks because of the increased residence time of the rinsing water, such that the floating substances thus formed adhere to the photographic material being processed. As a means of overcoming this problem, the method of reducing calcium and magnesium content of the rinsing water, described in JP-A-62-288838, is effectively employed in the present invention. In addition, isothiazolone compounds or thiabenzazoles described in JP-A-57-8542; chlorine-containing microbicides such as sodium chloroisocyanurates; as well as other microbicides described in H. Horiguchi, *Antibacterial and Antifungal Chemistry, Bactericidal and Fungicidal Techniques to Microorganisms* (edited by Association of Sanitary Technique ) and *Encyclopedia of Bactericidal and Fungicidal Agents* (edited by Nippon Bactericide and Fungicide Association, Japan) can also be used for overcoming the problem.

The rinsing water for use in processing the photographic material of the present invention has a pH value of from 4 to 9, preferably from 5 to 8. The rinsing temperature and the rinsing time may be appropriately selected in accordance with the characteristics and use of the photographic material being processed. In general, the rinsing temperature is from 15° to 45° C., preferably from 25° to 40° C., and the rinsing time is from 20 seconds to 2 minutes, preferably from 30 seconds to 1 minute.

Even by employing such short rinsing times, the processed photographic material may have good photographic characteristics without an increase in staining.

If desired, the photographic material of the present invention may directly be processed with a stabilizing solution without being rinsed in water. For such stabilization, any of known methods as described in JP-A-57-8543, JP-A-58-14834, JP-A-59-184343, JP-A-60-220345, JP-A-60-238832, JP-A-60-239784, JP-A-60-239749, JP-A-61-4054 and JP-A-61-118749 may be employed. In particular, a stabilizing bath containing 1-hydroxyethylidene-1,1-diphosphonic acid, 5-chloro-2-methyl-4-isothiazolin-3-one, or a bismuth compound or an ammonium compound is preferably employed.

If desired, the photographic material may be rinsed in water and then stabilized. One example of such a system is a stabilizing bath containing formaldehyde and a surfactant, for use as a final bath for processing picture-taking color photographic materials.

Next, the silver halide color photographic material for processing in accordance with the method of the present invention is described in detail below.

The silver halide emulsion constituting the silver halide emulsion layer of the photographic material of the present invention has a silver chloride content of 80 mol % or more, preferably 95 mol % or more, more preferably 98 mol % or more, of the total silver halide in the emulsion. For increasing the desilvering property of the photographic material, the silver chloride content of the silver halide emulsion is desirably as high as possible.

The present invention is especially effective for preventing the desilvering insufficiency and the cyan fading which tend to occur in the case of employing a high silver chloride emulsion and a high regeneration rate of the bleach-fixing solution. In particular, the effect of the present invention is especially remarkable in the case of processing a photographic material comprising a silver halide emulsion layer containing a silver halide emulsion having a silver chloride content of from 90 to 100 mol %, more preferably from 95 to 100 mol %, most preferably from 96 to 99.9 mol %.

The effect is quite unexpected from the results obtained by processing a conventional color photographic material having a silver chlorobromide emulsion, when the regeneration rate of the used bleach-fixing solution in processing the material is elevated. The high silver chloride emulsion of constituting the photographic material of the present invention may contain a small amount of silver bromide and silver iodide. Incorporation of such a small amount of silver bromide or silver iodide can often be advantageous for increasing the light-sensitivity of the material, or for increasing adsorption of a spectral sensitizing dye to the silver halide, or when the desensitization with a spectral sensitizing dye is prevented.

The silver halide grains used in the photographic material of the present invention may have different phases between the inside part of the grain and the surface part thereof (as core/shell grains), or may have a multi-layered structure bonded by a junction, or may have a uniform phase throughout the grain, or may have a composite structure composed of such various structures.

The mean grain size (the diameter of the grain when the grain is spherical or resembles a spherical shape, the mean value based on the projected area using the edge length as the grain size when the grain is a cubic grain, or the diameter of the corresponding circle when the grain is a tabular grain) of the silver halide grains for use in the present invention is preferably from 0.1 μm to 2 μm, and more preferably from 0.15 μm to 1.5 μm. The mean grain size distribution of the silver halide grains for use in the present invention may be narrow or broad, but a monodispersed silver halide emulsion wherein the value (variation coefficient) obtained by dividing the standard deviation in the grain size distribution curve of the silver halide emulsion by the mean grain size is within about ±20%, and preferably within ±15%, is preferably used in the present invention. Also, for satisfying the gradation required for a color photographic material, two or more kinds of monodispersed silver halide emulsions having different grain sizes can be present as a mixture thereof in one emulsion layer having substantially the same color sensitivity, or may each be arranged in separate emulsion layers, each emulsion having substantially the same color sensitivity. Furthermore, two or more kinds of polydispersed silver halide emulsions or a combination of a monodispersed emulsion and a polydispersed emulsion can be used as a mixture in the same emulsion layer, or may be arranged separately in two or more layers.

The silver halide grains for use in the present invention may have a regular crystal form such as cubic, octahedral, rhombic dodecahedral or tetradecahedral crystal form or a combination thereof, or an irregular crystal form such as spherical crystal form, or furthermore a composite form of these crystal forms. Also a tabular grain silver halide emulsion can be used in the present invention. In particular, a tubular grain silver halide emulsion having an aspect ratio (length/thickness) of 5 or more, especially 8 or more and accounting for 50% or more of the total projected area of the silver halide grains may be used. The silver halide emulsion for use in the present invention may be a mixture of these emulsions containing silver halide grains each having different crystal forms. Also the silver halide grains may be of a surface latent image type capable of forming latent images mainly on the surfaces thereof, or an internal latent image type capable of forming latent images mainly in the inside thereof.

The photographic emulsions for use in the present invention can be prepared by the method described in *Research Disclosure*, Vol. 176, Item No. 17643, I, II, III (December, 1978).

The amount of the silver halide emulsion to be coated on the silver halide color photographic material of the present invention is preferably 0.80 g/m$^2$ or less as silver, more preferably from 0.40 to 0.60 g/m$^2$ as silver.

The photographic emulsion is generally subjected to physical ripening, chemical ripening and spectral sensitization, for use in the present invention. The additives for use in the steps of ripening and sensitization are described in *Research Disclosure*, Vol. 176, No. 17643 (December, 1978), and ibid., Vol. 187, No. 18716 (November, 1979), and the relevant portions thereof are summarized in the following Table.

Known photographic additives for use in the present invention are also described in the above cited two *Research Disclosure* references, and the relevant portions thereof are also summarized in the following Table.

| No. | Additives | RD 17643 | RD 18716 |
|---|---|---|---|
| 1 | Chemical Sensitizer | p. 23 | p. 648, right column |
| 2 | Sensitivity Enhancer | p. 23 | p. 648, right column |
| 3 | Spectral Sensitizer | pp. 23–24 | from p. 648, right |

-continued

| No. | Additives | RD 17643 | RD 18716 |
|---|---|---|---|
| | | | column to p. 649, right column |
| 4 | Super Color Sensitizer | pp. 23–24 | |
| 5 | Brightening Agent | p. 24 | |
| 6 | Anti-Foggant Stabilizer | pp. 24–25 | p. 649, right column |
| 7 | Coupler | p. 25 | p. 649, right column |
| 8 | Organic Solvent | p. 25 | p. 649, right column |
| 9 | Light Absorbent Filter Dye | pp. 25–26 | from p. 649, right column to p. 650, left column |
| 10 | UV Absorbent | pp. 25–26 | from p. 649, right column to p. 650, left column |
| 11 | Stain Inhibitor | p. 25, right column | p. 650, from left to right column |
| 12 | Color Image Stabilizer | p. 25 | p. 650, from left to right column |
| 13 | Hardening Agent | p. 26 | p. 651, left column |
| 14 | Binder | p. 26 | p. 651, left column |
| 15 | Plasticizer Lubricant | p. 27 | p. 650, right column |
| 16 | Coating Aid Surfactant | pp. 26–27 | p. 650, right column |
| 17 | Anti-Static Agent | p. 27 | p. 650, right column |

Various kinds of color couplers can be used in the present invention. The color coupler referred to herein is a compound capable of forming a dye by a coupling reaction with the oxidation product of an aromatic primary amine developing agent. Specific examples of useful color couplers include naphthol or phenol compounds, pyrazolone or pyrazoloazole compounds and open-chain or heterocyclic ketomethylene compounds. Examples of cyan, magenta and yellow couplers for use in the present invention are described in the patent publications as referred to in *Research Disclosure (RD)*, No. 17643, (December, 1978), VII-D and ibid., No. 18717 (November, 1979).

The couplers preferably incorporated into the color photographic material for processing in accordance with the method of the present invention are fast to diffusion by providing the coupler with a ballast group, or by polymerization. Also, the use of 2-equivalent color couplers substituted by a releasing group is preferred for reducing the amount of silver in the color photographic material as compared to 4-equivalent color couplers having a hydrogen atom at the coupling active position. Couplers which form colored dyes having a proper diffusibility, non-color-forming couplers, DIR couplers releasing a development inhibitor by a coupling reaction, or DAR couplers which release a development accelerator by a coupling reaction can also be used in the present invention.

Yellow couplers for use in the present invention include oil protect type acylacetamido couplers as a typical example. Specific examples of these couplers are described in U.S. Pat. Nos. 2,407,210, 2,875,057 and 3,265,506. In the present invention, 2-equivalent yellow couplers are preferably used and specific examples of these yellow couplers are oxygen atom releasing type yellow couplers described in U.S. Pat. Nos. 3,408,194, 3,447,928, 3,933,501 and 4,022,620, and nitrogen atom releasing type yellow couplers described in JP-B-58-10739, U.S. Pat. Nos. 4,401,752, 4,326,024, *Research Disclosure*, No. 18053 (April, 1979), British Patent 1,425,020, German Patent OLS Nos. 2,219,917, 2,261,361, 2,329,587, 2,261,361, 2,329,587 and 2,433,812. Of these yellow couplers, α-pivaloylacetanilide couplers have excellent light fastness of the colored dyes formed, while α-benzoylacetanilide couplers have excellent coloring density.

Magenta couplers for use in the present invention include oil protect type indazolone or cyanoacetyl couplers, and preferably 5-pyrazolone magenta couplers and other pyrazoloazole couplers such as pyrazolotriazoles. The 5-pyrazolone couplers substituted by an arylamino group or an acylamino group at the 3-position thereof are preferred with respect to hue and coloring density of the colored dyes formed. Specific examples of these couplers are described in U.S. Pat. Nos. 2,311,082, 2,343,703, 2,600,788, 2,908,573, 3,062,653, 3,152,896 and 3,936,015. Also as the releasing groups for 2-equivalent 5-pyrazolone couplers, the nitrogen atom releasing groups described in U.S. Pat. No. 4,310,619 and arylthio groups described in U.S. Pat. No. 4,351,897 are preferred. Furthermore, 5-pyrazolone magenta couplers having a ballast group as described in European Patent 73,636 provide high coloring density.

Pyrazoloazole couplers for use in the present invention include the pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure*, No. 24220 (June, 1984), and pyrazolopyrazoles described in *Research Disclosure*, No. 24230 (June, 1984). The imidazo[1,2-b]pyrazoles described in European Patent 119,741 are preferred because of the small yellow side-absorption of the colored dye and of the degree of light-fastness thereof, and in particular, the pyrazolo[1,5][1,2,4]triazoles described in European patent 119,860 are especially preferred.

Cyan couplers for use in the present invention include oil protect type naphthol or phenol couplers. Specific examples of naphthol couplers include the cyan couplers described in U.S. Pat. No. 2,474,293 and preferably oxygen atom releasing type 2-equivalent naphthol couplers described in U.S. Pat. Nos. 4,052,212, 4,146,396, 4,228,233 and 4,296,200. Also, specific examples of phenol cyan couplers are described in U.S. Pat. Nos. 2,369,929, 2,801,171, 2,772,162 and 2,895,826. Cyan couplers having high fastness to humidity and temperature are preferably used in the present invention, and specific examples of these cyan couplers include phenol cyan couplers having an alkyl group of 2 or more carbon atoms at the meta-position of the phenol nucleus as described in U.S. Pat. No. 3,772,022; 2,5-diacylamino-substituted phenol cyan couplers as described in U.S. Pat. Nos. 2,772,162, 3,758,308, 4,126,396, 4,334,011, 4,327,173, German Patent OLS No. 3,329,729 and JP-A-59-166956; and phenol couplers having a phenylureido group at the 2-position of the phenol nucleus and an acylamino group at the 5-position thereof as described in U.S. Pat. Nos. 3,446,622, 4,333,999, 4,451,559 and 4,427,767. It is especially preferred that the photographic material for processing in accordance with the method of the present invention contains a cyan coupler as represented by the following formula (C). The photographic material containing such a cyan coupler is especially preferred for processing in accordance with the method of the present invention. The present inventors have discovered that the method of the present invention characterized by the particular regeneration system disclosed and claimed herein is especially effective for providing stable cyan dye images upon storage at high temperature (i.e., prevent image fading under heat). Specifically, the method of the present invention surprisingly overcomes color reproduction failure of cyan dye images and fading of cyan dye images under heat, even though the method is carried out under severe conditions where large amounts of components are eluted from the photographic material being processed, and where large amounts of components are carried over from the previous bath.

In view of the above, incorporation of a cyan coupler of formula (C) into the photographic material to be processed in accordance with the method of the present invention is effective when the regeneration percentage as defined above is 80% or more, especially 90% or more.

Next, cyan couplers of formula (C) are described in detail below.

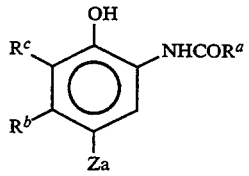

(C)

In formula (C), $R^a$ represents an alkyl group, a cycloalkyl group, an aryl group, an amino group, or a heterocyclic group;

$R^b$ represents an acylamino group, or an alkyl group having two or more carbon atoms;

$R^c$ represents a hydrogen atom, a halogen atom, an alkyl group or an alkoxy group; and $R^c$ may be bonded to $R^b$ to form a ring; and Za represents a hydrogen atom, a halogen atom, or a group which is released upon reaction with an oxidation product of an aromatic primary amine color developing agent.

The alkyl group and cycloalkyl group represented by $R^a$ in formula (C) preferably has from 1 to 32 carbon atoms, which includes, for example, a methyl group, a butyl group, a tridecyl group, a cyclohexyl group and an allyl group. The aryl group represented by $R^a$ preferably has from 6 to 40 carbon atoms, and especially 6 to 30 carbon atoms, and includes, for example, a phenyl group and a naphthyl group. The heterocyclic group of the same is preferably in the form of a 5-membered or 6-membered ring containing at least one hetero atom selected from oxygen, nitrogen and sulfur atoms, and includes, for example, a 2-pyridyl group and a 2-furyl group.

Where $R^a$ represents an amino group, it is especially preferably a phenyl-substituted amino group which may be further substituted.

The group represented by Ra may be substituted by one or more substituents selected from an alkyl group, an aryl group, an alkyl or aryloxy group (e.g., methoxy, dodecyloxy, methoxyethoxy, phenyloxy, 2,4-di-tert-amylphenoxy, 3-tert-butyl-4-hydroxyphenyloxy, naphthyloxy), a carboxyl group, an alkyl or arylcarbonyl group (e.g., acetyl, tetradecanoyl, benzoyl), an alkyl or aryloxycarbonyl group (e.g., methoxycarbonyl, phenoxycarbonyl), an acyloxy group (e.g., acetyl, benzoyloxy), a sulfamoyl group (e.g., N-ethylsulfamoyl, N-octadecylsulfamoyl), a carbamoyl group (e.g., N-ethylcarbamoyl, N-methyl-dodecylcarbamoyl), a sulfonamido group (e.g., methanesulfonamido, benzenesulfonamido), an acylamino group (e.g., acetylamino, benzamido, ethoxycarbonylamino, phenylaminocarbonylamino), an imido group (e.g., succinimido, hydantoinyl), a sulfonyl group (e.g., methanesulfonyl), a hydroxyl group, a cyano group, a nitro group, and a halogen atom.

The acylamino group represented by $R^b$ of formula (C) preferably has up to 30 carbon atoms and includes a dichloroacetylamino group and a heptafluorobutyrylamino group. The alkyl group having two or more carbon atoms represented by $R^b$ includes an ethyl group, a propyl group, a butyl group, a pentadecyl group, a tert-butyl group, a phenylthioethyl group and a methoxyethyl group. $R^b$ is preferably an alkyl group having from 2 to 15 carbon atoms and is especially preferably an alkyl group having from 2 to 4 carbon atoms.

The halogen atom represented by $R^c$ in formula (C) includes, for example, a chlorine atom, a bromine atom and a fluorine atom. The alkyl group represented by $R^c$ includes, for example, a methyl group, an ethyl group, a propyl group, a butyl group, a pentadecyl group, a tert-butyl group, a cyclohexylmethyl group, a phenylthiomethyl group, a dodecyloxyphenylthiomethyl group, a butanamidomethyl group and a methoxymethyl group, and preferably has up to 10 carbon atoms. The alkoxy group represented by $R^c$ includes, for example, an ethoxy group, a dodecyloxy group, a methoxyethylcarbamoylmethoxy group, a 3-(methanesulfonamido)propyloxy group, a carboxypropyloxy group and a methylsulfonylethoxy group, and preferably has up to 10 carbon atoms. $R^c$ is preferably a hydrogen atom or a halogen atom and is especially preferably a chlorine atom or a fluorine atom.

In formula (C), Za represents a hydrogen atom or a coupling releasing group. Examples of the coupling releasing group represented by Za include a halogen atom (e.g., fluorine, chlorine, bromine), an alkoxy group (e.g., dodecyloxy, methoxycarbamoylmethoxy, carboxypropyloxy, methylsulfonylethoxy), an aryloxy group (e.g., 4-chlorophenoxy, 4-methoxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., phenylthio, tetrazolylthio), an imido group (e.g., succinimido, hydantoinyl), an N-heterocyclic group (e.g., 1-pyrazolyl, 1-benzotriazolyl), and an aromatic azo group (e.g., phenylazo). The releasing group represented by Za may contain a photographically useful group.

Compounds of formula (C) may form dimers or higher polymers at the position of $R^a$ or $R^b$.

Specific nonlimiting examples of cyan couplers of formula (C) are listed below.

(C-1)
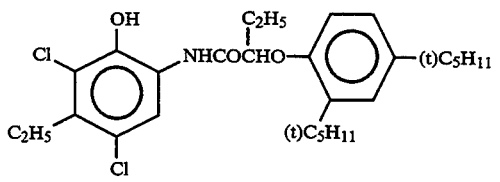
(C-2)
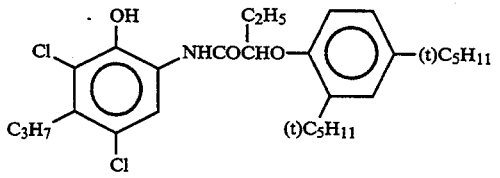
(C-3)
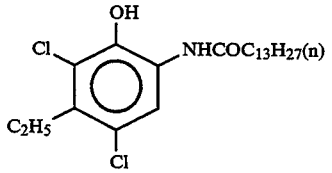
(C-4)
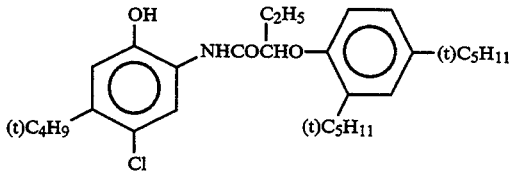
(C-5)
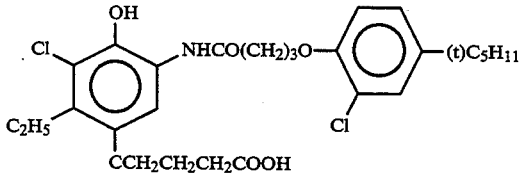
(C-6)
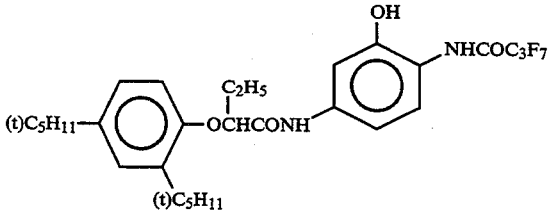
(C-7)
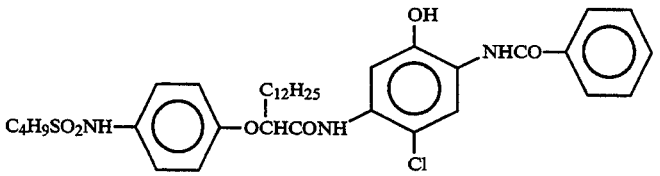
(C-8)
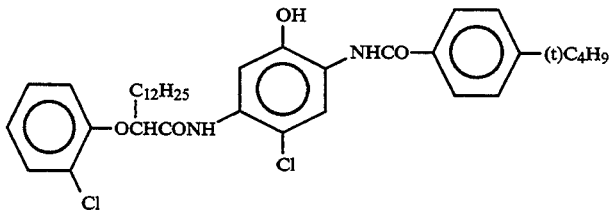

-continued
(C-9)
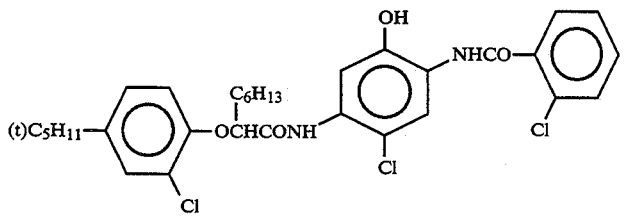
(C-10)
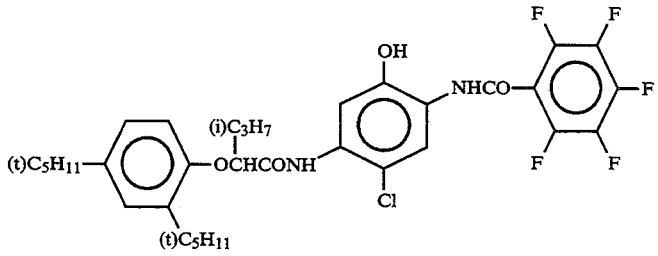
(C-11)
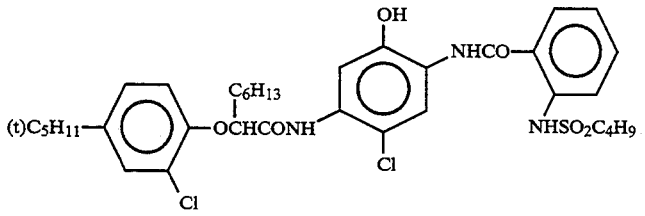
(C-12)
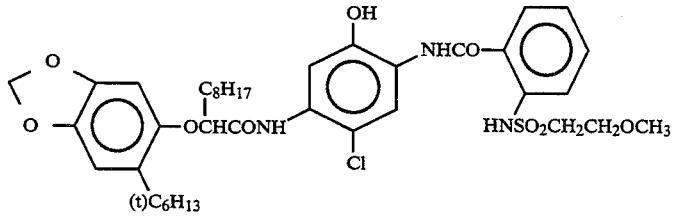
(C-13)
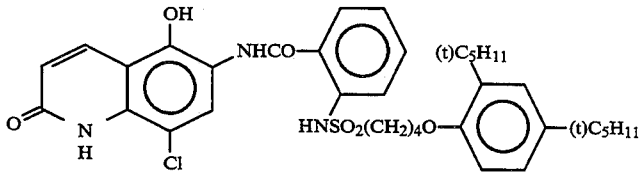
(C-14)
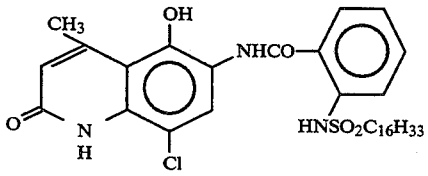
(C-15)
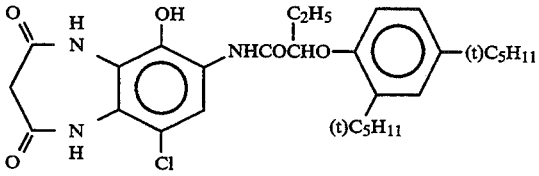

-continued
(C-16)
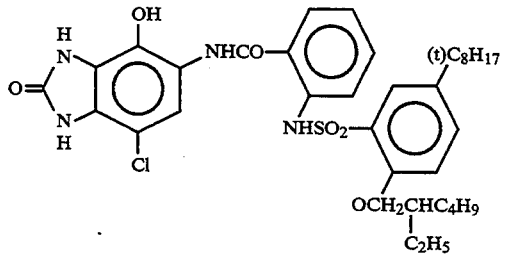
(C-17)
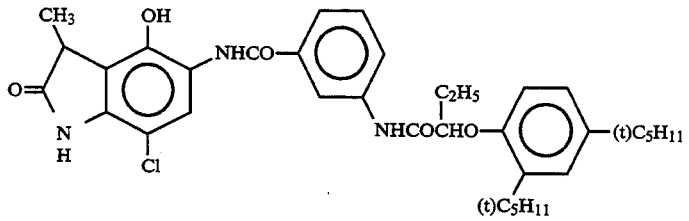
(C-18)
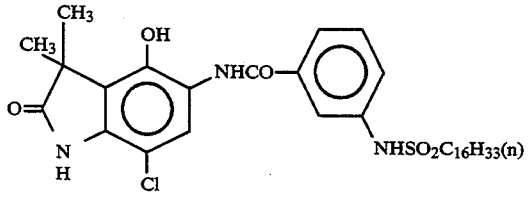
(C-19)
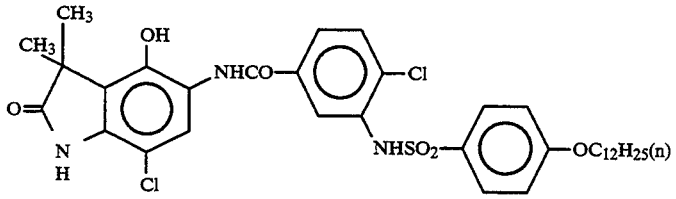
(C-20)
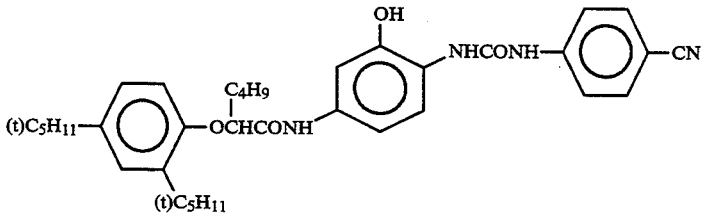
(C-21)
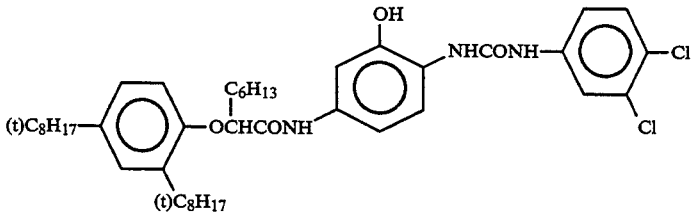
(C-22)
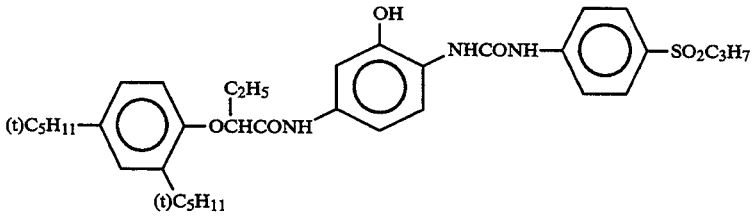

-continued (C-23)

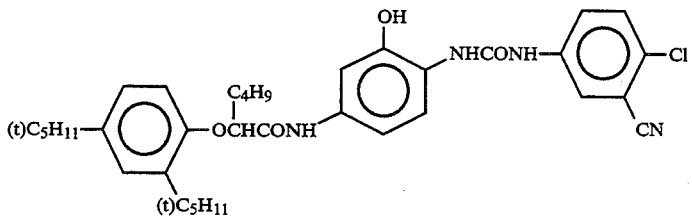

(C-24)

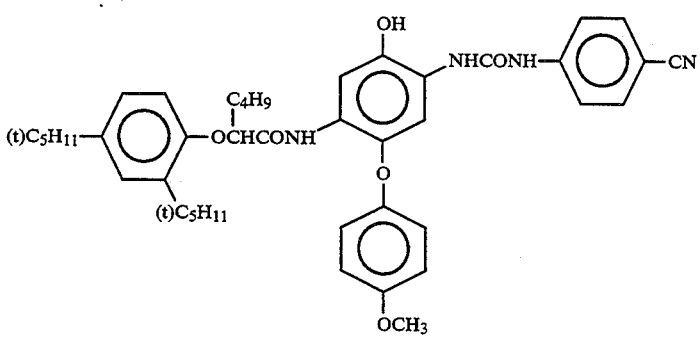

(C-25)

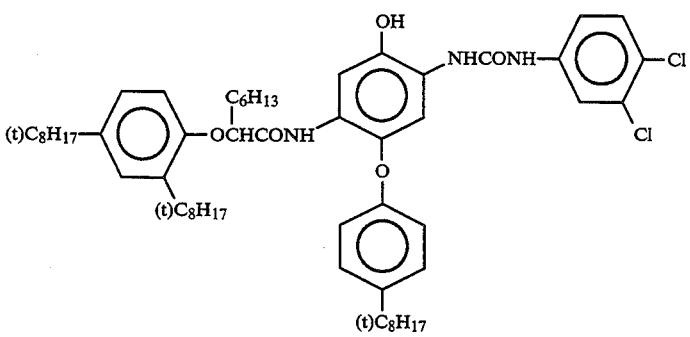

(C-26)

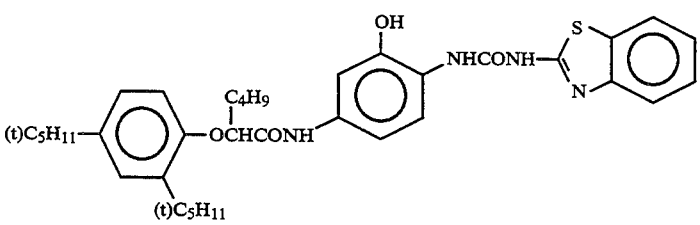

Cyan couplers of formula (C) can be prepared in accordance with the descriptions of JP-A-59-166956 and JP-B-49-11572.

The cyan coupler is preferably contained in a red-sensitive emulsion layer.

The content of the cyan coupler of formula (C) in the photographic material of the present invention is not particularly limited, but is generally from $1\times10^{-4}$ to $1\times10^{-2}$ mol, preferably from $1\times10^{-5}$ to $1\times10^{-3}$ mol, per $m^2$ of the photographic material.

In the present invention, by using couplers providing colored dyes having a proper diffusibility together with the above noted color couplers, the graininess of color images thereby formed can be improved. Specific examples of magenta couplers of this type are described in U.S. Pat. No. 4,366,237 and British Patent 2,125,570; and specific examples of yellow, magenta and cyan couplers of this type are described in European Patent 96,570 and German Patent OLS No. 3,234,533.

Dye-forming couplers and the above-described specific couplers for use in the present invention may form dimers or higher polymers. Typical examples of polymerized dye-forming couplers are described in U.S. Pat. Nos. 3,451,820 and 4,080,211. Also, specific examples of polymerized magenta couplers are described in British Patent 2,102,173 and U.S. Pat. No. 4,367,282.

Various kinds of couplers may be used in the same photographic layer of the color photographic material of the present invention as a combination of two or more kinds thereof for meeting the particular characteristics desired for the color photographic material, or the same kind of coupler may be used in two or more photographic layers for meeting desired characteristics.

The couplers for use in the present invention can be incorporated into the photographic material of the present invention by means of various known dispersion methods. For example, an oil-in-water dispersion method is one such technique, and examples of high boiling point organic solvents for use in the oil-in-water dispersion method are described in U.S. Pat. No. 2,322,027. Another example is a latex dispersion method, and the procedure, effect and examples of latexes for impregnation are described in U.S. Pat. No. 4,199,363 and German Patent OLS Nos. 2,541,274 and 2,541,230. Still another example is a dispersion method by the use of an organic solvent-soluble polymer as described in International Publication No. WO 88/00723.

Examples of organic solvents for use in the above-described oil-in-water dispersion method include alkyl phthalates (e.g., dibutyl phthalate, dioctyl phthalate), phosphates (e.g., diphenyl phosphate, triphenyl phosphate, tricresyl phosphate, dioctylbutyl phosphate), citrates (e.g., tributyl acetylcitrate), benzoates (e.g., octyl benzoate), alkylamides (e.g, diethyllaurylamide), fatty acid esters (e.g., dibutoxydiethyl succinate, diethyl azelate), and trimesates (e.g., tributyl trimesate). If desired, other organic solvents having a boiling point of from about 30° C. to 150° C., for example, lower alkyl acetate (e.g., ethyl acetate, butyl acetate), ethyl propionate, secondary butyl alcohol, methyl isobutyl ketone, $\beta$-ethoxyethyl acetate or methyl cellosolve acetate, can be used as auxiliary solvents together with the above-described organic solvents.

The amount of the color coupler to be incorporated into the photographic material of the present invention is generally in the range of from 0.001 to 1 mol per mol of the light-sensitive silver halide in the emulsion; and the preferred amount is from 0.01 to 0.5 mol for a yellow coupler, from 0.003 to 0.3 mol for a magenta coupler, and from 0.002 to 0.3 mol for a cyan coupler.

In preparing the photographic material for processing by the method of the present invention, photographic emulsions are coated on a conventional flexible support such as a plastic film (e.g., cellulose nitrate, cellulose acetate, polyethylene terephthalate) or paper or a conventional rigid support such as glass. The details of the supports and the coating means are described in *Research Disclosure*, Vol. 176, Item No. 17643, XV (page 27) and XVII (page 28), (December, 1978).

In the present invention, a reflective support is preferably used. The "reflective support" has a reflectivity for clearly viewing the dye images formed in the silver halide emulsion layers of a color photographic material, and this includes a support coated with a hydrophobic resin having dispersed therein a light reflective material such as titanium oxide, zinc oxide, calcium carbonate or calcium sulfate, and a support composed of a hydrophobic resin having dispersed therein a light reflective material as described above.

The following examples are intended to illustrate the present invention, but are not to be construed as limiting the invention in any way.

EXAMPLE 1

A multilayer color photographic paper was prepared by forming the layers having the compositions shown below on a paper support, both surfaces of which were coated with polyethylene. The coating compositions for the layers were prepared as follows:

Coating Composition for First Layer 27.2 cc of ethyl acetate and 8.2 g of solvent (Solv1) were added to 19.1 g of yellow coupler (ExY) and 4.4 g of color image stabilizer (Cpd-1) and dissolved, and the resulting solution was dispersed by emulsification in 185 cc of an aqueous 10 wt % gelatin solution containing 8 cc of 10 wt % sodium dodecylbenzenesulfonate. On the other hand, the blue-sensitizing dyes noted below were added to a silver chlorobromide emulsion (3/7 mixture (by mol as Ag) of large cubic grains having a mean grain size of 0.88 $\mu$m and a variation coefficient of grain size distribution of 0.08, and small cubic grains having a mean grain size of 0.70 $\mu$m and a variation coefficient of grain size distribution of 0.10; both large and small grains contained 0.2 mol % of silver bromide locally on the surface of the grain), each in an amount of $2.0\times10^{-4}$ mol per mol of silver to the large grain emulsion part and each in an amount of $2.5\times10^{-4}$ mol per mol of silver to the small grain emulsion part. After the addition, the emulsion was sulfur-sensitized. The previously prepared dispersion and the emulsion were blended to obtain a coating composition for the first layer, as described below.

Other coating compositions for the second to seventh layers were also prepared in the same manner as above. As a gelatin hardening agent, 1-hydroxy-3,5-dichloro-s-triazine sodium salt was added to each layer.

Color sensitizing dyes used for the respective light-sensitive layers are given below.

Blue-Sensitive Emulsion Layer

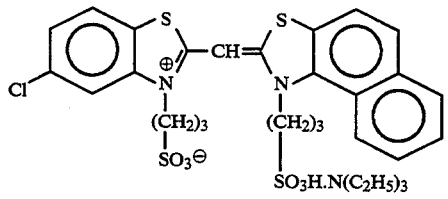

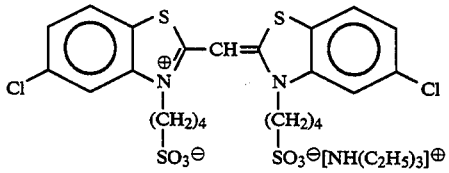

(The dyes were added to the large size emulsion part each in an amount of $2.0\times10^{-4}$ mol per mol of silver halide and to the small size emulsion part each in an amount of $2.5\times10^{-4}$ mol per mol of silver halide.)

Green-Sensitive Emulsion Layer

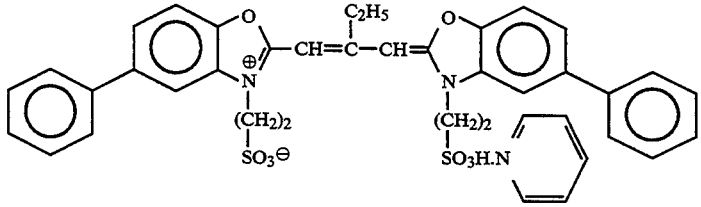

(The dye was added to the large size emulsion part in an amount of $4.0\times10^{-4}$ mol per mol of silver halide and to the small size emulsion part in an amount of $5.6\times10^{-4}$ mol per mol of silver halide.) and

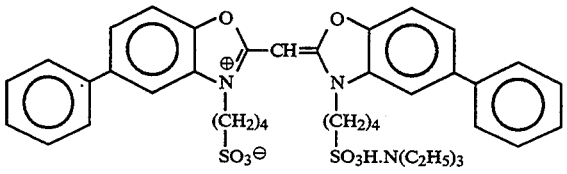

(The dye was added to the large size emulsion part in an amount of $7.0\times10^{-5}$ mol per mol of silver halide and to the small size emulsion part in an amount of $1.0\times10^{-5}$ mol per mol of silver halide.)

Red-Sensitive Emulsion Layer

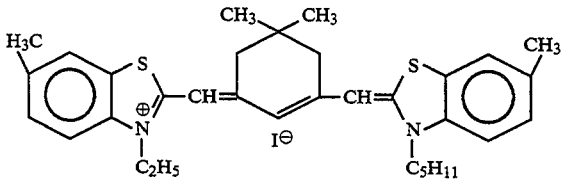

(The dye was added to the large size emulsion part in an amount of $0.9\times10^{-4}$ mol per mol of silver halide and to the small size emulsion part in an amount of $1.1\times10^{-4}$ mol per mol of silver halide.)

To the red-sensitive emulsion layer was added the following compound in an amount of $2.6\times10^{-3}$ mol per mol of silver halide.

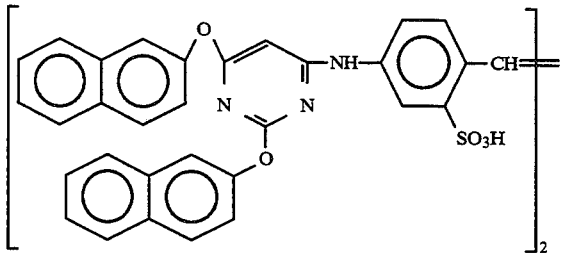

To the blue-sensitive emulsion layer, green-sensitive emulsion layer and red-sensitive emulsion layer were added 1-(5-methylureidophenyl)-5-mercaptotetraxole in an amount of $8.5\times10^{-5}$ mol, $7.7\times10^{-4}$ mol and $2.5\times10^{-4}$ mol, respectively.

To the blue-sensitive emulsion layer and green-sensitive emulsion layer, was added 4-hydroxy-6-methyl-1,3,3a,7-tetrazaindene in an amount of $1\times10^{-4}$ mol and $2\times10^{-4}$ mol, respectively.

For anti-irradiation, the following dyes were added to the emulsion layers.

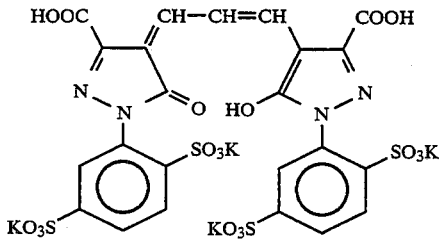

and

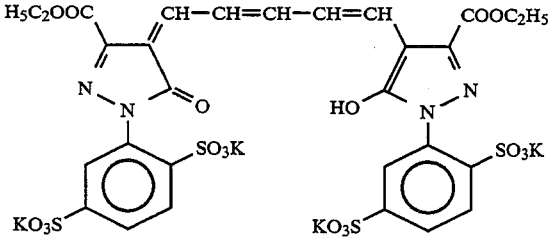

Layer Constitution

Components of constituting the respective layers are shown below. The number indicates the amount coated (as g/m²). The amount of silver halide emulsion coated is given in terms of the silver contained therein.

Support

Polyethylene Laminated Paper (containing white pigment of $TiO_2$ and bluish dye of ultramarine in a polyethylene coat below the first layer)

| | |
|---|---|
| First Layer: Blue-Sensitive Layer | |
| Above-described Silver Chlorobromide Emulsion | 0.30 |
| Gelatin | 1.86 |
| Yellow Coupler (ExY) | 0.82 |
| Color Image Stabilizer (Cpd-1) | 0.19 |
| Solvent (Solv-1) | 0.35 |
| Color Image Stabilizer (Cpd-7) | 0.06 |
| Second Layer: Color Mixing Preventing Layer | |
| Gelatin | 0.99 |
| Color Mixing Preventing Agent (Cpd-5) | 0.08 |
| Solvent (Solv-1) | 0.16 |
| Solvent (Solv-4) | 0.08 |
| Third Layer: Green-Sensitive Layer | |
| Silver Chlorobromide Emulsion (⅓ mixture (by mol as Ag) of cubic grains having a mean grain size of 0.55 μm and a variation coefficient of grain size distribution of 0.10, and cubic grains having a mean grain size of 0.39 μm and a variation coefficient of grain size distribution of 0.08; both grains containing 0.8 mol % of AgBr locally on the surface of the grain) | 0.12 |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer: Ultraviolet Absorbing Layer | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |
| Fifth Layer: Red-Sensitive Layer | |
| Silver Chlorobromide Emulsion (¼ mixture (by mol as Ag) of cubic grains having a mean grain size of 0.55 μm and a variation coefficient of grain size distribution of 0.09, and cubic grains having a mean grain size of 0.45 μm and a variation coefficient of grain size distribution of 0.11; | 0.23 |

-continued

| | |
|---|---|
| both grains containing 0.6 mol % of AgBr locally on a part of the surface of the grain) | |
| Gelatin | 1.34 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer: Ultraviolet Absorbing Layer | |
| Gelatin | 0.53 |
| Ultraviolet Absorbent (UV-1) | 0.16 |

-continued

| | |
|---|---|
| Color Mixing Preventing Agent (Cpd-5) | 0.02 |
| Solvent (Solv-5) | 0.08 |
| Seventh Layer: Protective Layer | |
| Gelatin | 1.33 |
| Acryl-modified Copolymer of Polyvinyl Alcohol (with modification degree of 17%) | 0.17 |
| Liquid Paraffin | 0.03 |

Compounds used in preparing the above-described sample were as follows:

(ExY) Yellow Coupler:

1/1 Mixture (by mol) of the following compounds:

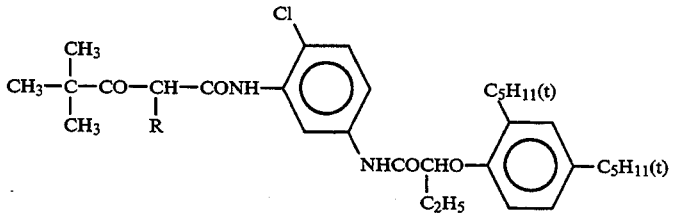

R =

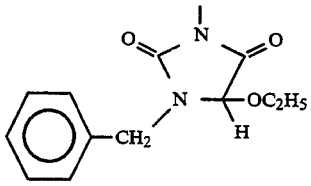

R =

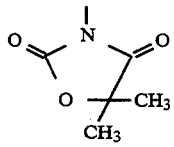

(ExM) Magenta Coupler:

1/1 Mixture (by mol) of the following compounds:

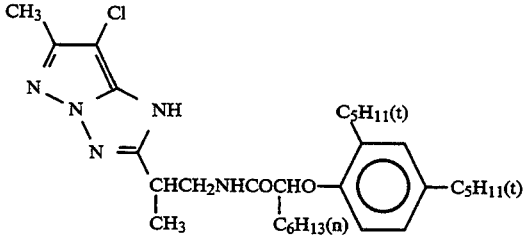

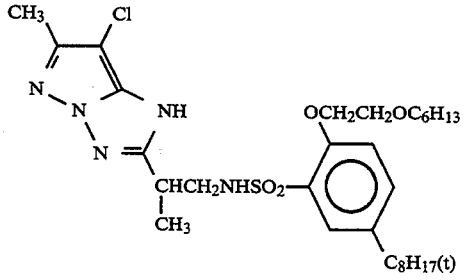

(ExC) Cyan Coupler:

2/4/4 Mixture (by weight) of the following compounds:

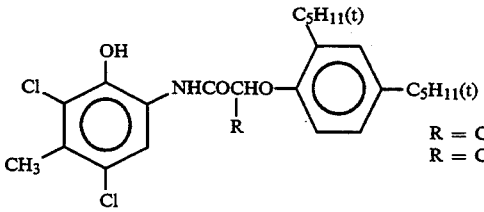

R = $C_2H_5$; and
R = $C_4H_9$

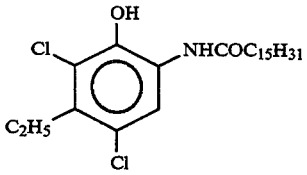

(Cpd-1) Color Image Stabilizer:

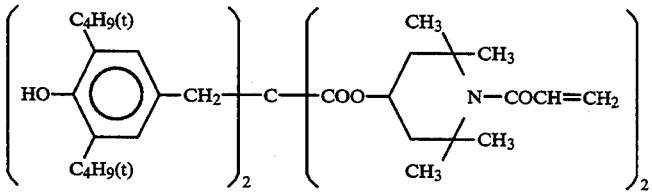

(Cpd-2) Color Image Stabilizer:

(Cpd-3) Color Image Stabilizer:

-continued

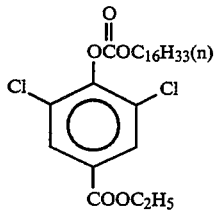

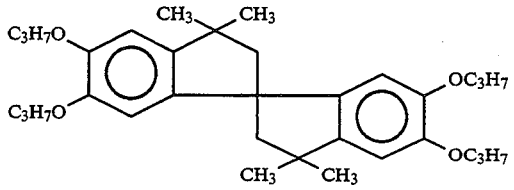

(Cpd-4) Color Image Stabilizer:

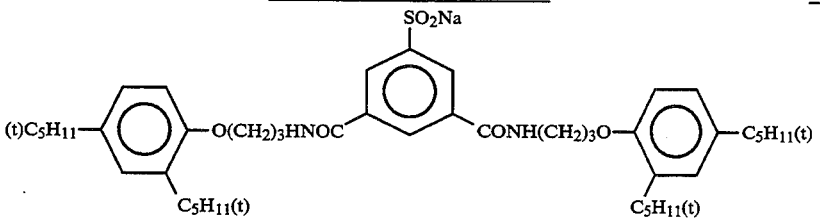

(Cpd-5) Color Mixing Preventing Agent:

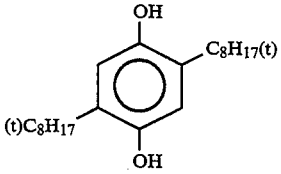

(Cpd-6) Color Image Stabilizer:
2/4/4 Mixture (by weight) of the following compounds:

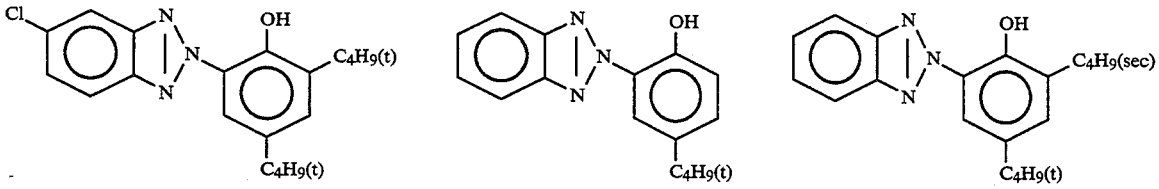

(Cpd-7) Color Image Stabilizer:

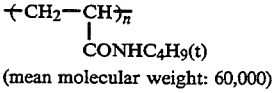

(mean molecular weight: 60,000)

(Cpd-8) Color Image Stabilizer:
1/1 Mixture of the following compounds:

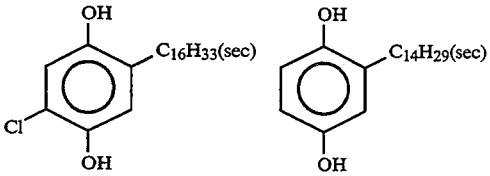

(Cpd-9) Color Image Stabilizer:

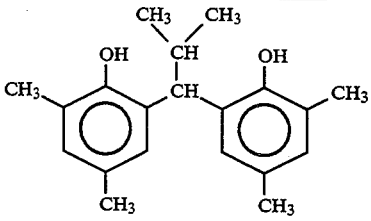

(UV-1) Ultraviolet Absorbent:
4/2/4 Mixture (by weight) of the following compounds:

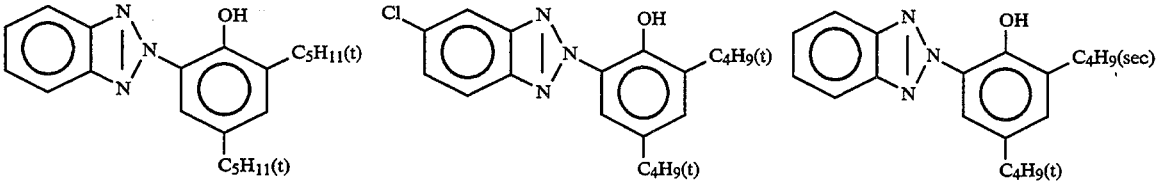

(Solv-1) Solvent:

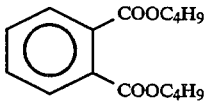

(Solv-2) Solvent:
2/1 Mixture (by volume) of the following compounds:

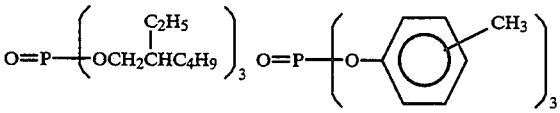

(Solv-4) Solvent:

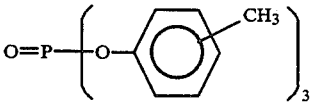

(Solv-5) Solvent:

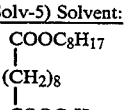

(Solv-6) Solvent

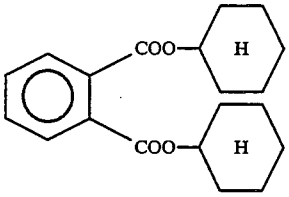

The sample thus prepared was called sample (1-A).

| Sample | Blue-sensitive Layer (Cl %) | Green-sensitive Layer (Cl %) | Red-sensitive Layer (Cl %) |
|---|---|---|---|
| 1-A | 99.8 | 99.2 | 99.4 |
| 1-B | 95.0 | 95.2 | 95.2 |
| 1-C | 90.0 | 91.2 | 91.2 |
| 1-D | 80.3 | 81.0 | 81.0 |
| 1-E | 72.3 | 71.8 | 71.8 |

Samples (1-A) to (1-E) were imagewise exposed and then processed in accordance with the continuous processing procedure described below.

| Processing Steps | | | | |
|---|---|---|---|---|
| Step | Time | Temp. | Amount of Replenisher (*) | Tank Capacity |
| Color Development | 45 sec | 38 | 98 ml | 500 liters |
| Bleach-fixation | 45 sec | 35° C. | 218 ml | 500 liters |
| Rinsing (1) | 20 sec | 35° C. | — | 200 liters |
| Rinsing (2) | 20 sec | 35° C. | — | 200 liters |
| Rinsing (3) | 20 sec | 35° C. | — | 200 liters |
| Rinsing (4) | 30 sec | 35° C. | 220 ml | 200 liters |
| Drying | 1 min | 60–80° C. | | |

(*) Amount of replenisher was per $m^2$ of sample processed.

Rinsing was effected by a cascade rinsing system from (4) to (3) to (2) to (1). The amount of carryover of the developer to the bleach-fixing step and the carryover of the bleach-fixing solution to the rinsing step each were 60 ml per $m^2$ of the sample processed. The crossover time was 10 seconds for each transition period, and this time was included in the processing time for the previous step. The processing solutions used above had the following compositions.

| | Mother Solution (g) | Replenisher (g) |
|---|---|---|
| Color Developer: | | |
| Triethanolamine | 5.8 | 11.6 |
| Polyvinyl Alcohol (saponification degree 74%) | 1.0 | 1.0 |
| 1-Hydroxyethylidene-1,1-diphosphonic Acid | 0.3 | 0.6 |
| Pentasodium Diethylenetriamine-pentaacetate | 1.5 | 3.0 |
| Pentasodium Nitrilotris(methylene-phosphonate) | 4.7 | 9.4 |
| Potassium Chloride | 2.3 | — |
| Potassium Bromide | 0.01 | — |
| Hydrazinodiacetic Acid | 3.5 | 7.0 |
| N-ethyl-N-(β-methanesulfonamido-ethyl)-3-methyl-4-aminoaniline Sulfate | 4.75 | 9.5 |
| Brightening Agent (WHITEX 4, product of Sumitomo Chemical) | 1.25 | 2.5 |
| Potassium Carbonate | 26.0 | 26.0 |
| Water to make | 1.0 liter | 1.0 liter |
| pH | 10.05 | 10.60 |
| Bleach-Fixing Solution: | | |
| Ammonium Thiosulfate Aqueous Solution (700 g/liter) | 110 ml | 140 ml |
| Ammonium Ethylenediaminetetra-acetato/Iron(III) Dihydrate | 40.0 | 50.0 |
| Ammonium Sulfite | 25.0 | 40.0 |
| Acetic Acid to adjust | pH of 6.00 | pH of 5.70 |
| Water to make | 1.0 liter | 1.0 liter |

Rinsing Water

Ion-exchanged water having a calcium ion concentration and a magnesium ion concentration of each 3 ppm or less was used as the rinsing water.

During the process, the bleach-fixing solution was regenerated in accordance with the method described below. Specifically, any one of the regenerating agents noted below was added to the overflow from the bleach-fixing tank each time the pooled amount of overflow became 200 liters, and the regenerating agent-containing overflow was used as the replenisher. During the process, regeneration was thus repeated 15 times, and a regeneration percentage of 100% was employed, namely, all of the overflow was returned as a regenerated replenisher without the addition of any fresh replenisher to the system.

Compositions of the regenerating agents used are shown below. The amount of each component is per liter of overflow.

| Regenerating Agent (I): | |
|---|---|
| Ammonium Thiosulfate | 29.1 g |
| Ammonium Ethylenediaminetetraacetato/Iron(III) Dihydrate | 16.2 g |
| Ammonium Sulfite (96 wt %) | 33.3 g |
| Sodium Diacetate | 62.5 g |

The proportion of the solid weight (i.e., the sum of the weight of the components of the regenerating agent which are solids at room temperature) to the total weight of the agent was 100 wt %.

| Regenerating Agent (II): | |
|---|---|
| Ammonium Thiosulfate | 29.1 g |
| Ammonium Ethylenediaminetetraacetato/Iron(III) Dihydrate | 16.2 g |
| Sodium Sulfite | 30.0 g |
| Glacial Acetic Acid | 18.2 ml |

The proportion of the solid weight to the total weight of the agent was 82 wt %.

Regenerating Agent (III)

Water was added to regenerating agent (I) such that the proportion of the solid weight to the total weight of the agent was adjusted to be 80 wt %.

Regenerating Agent (IV)

Water was added to regenerating agent (I) such that the proportion of the solid weight to the total weight of the agent was adjusted to be 70 wt %.

Regenerating Agent (V)

Water was added to regenerating agent (I) such that the proportion of the solid weight to the total weight of the agent was adjusted to be 50 wt %.

Next, samples (1-A) to (1-E) were wedgewise exposed and then processed. The amount of silver remaining in the maximum density portion of the processed samples was analyzed by X-ray fluorescence analysis, and the results obtained are shown in Table 1 below.

In order to evaluate the color reproducibility of each sample, the processed samples were re-treated with a bleaching solution (CN-16$N_2$ (product of Fuji Photo Film) for bleaching of color negative films), at 25° C. for 4 minutes, whereupon the fluctuation, if any, of the cyan density was measured. Taking the point having a cyan density of 2.0 after re-treatment as 100%, the cyan density of the same point before re-treatment was represented by the coloration percentage (%).

The samples were evaluated after the regeneration was repeated 15 times.

The results obtained are shown in Table 1 below.

Only when the samples of the present invention (1-A), (1-B), (1-C) and (1-D) each having a high silver chloride content emulsion were processed in accordance with the method of the present invention, and where the used bleach-fixing solution (overflow from bleach-fixing bath) was repeatedly regenerated with the regenerating agent of the present invention, the amount of residual silver was small and the cyan dye color reproducibility was excellent. Thus, the running test results were good only when the method of the present invention was employed. In particular, the effects of the present invention were remarkable when samples (1-A) and (1-B) each having an emulsion having a silver chloride content of more than 95 mol % were processed. On the other hand, processing of comparative sample (I-E) having a silver chloride content outside the scope of the present invention resulted in both poor desilvering and color reproducibility. Furthermore, processing using the comparative regenerating agent V having a solids content outside the scope of the present invention also resulted in both poor desilvering and color reproducibility.

TABLE 1

| Sample | Regenerating Agent | Residual Silver ($\mu g/cm^2$) | Coloration Percentage (%) | Remarks |
|---|---|---|---|---|
| 1-A | I | 2 | 100 | Invention |
| 1-B | " | 2 | 100 | " |
| 1-C | " | 4 | 99 | " |
| 1-D | " | 6 | 98 | " |
| 1-E | " | 14 | 88 | |
| 1-A | II | 3 | 99 | Invention |
| 1-B | " | 3 | 99 | " |
| 1-C | " | 5 | 97 | " |
| 1-D | " | 7 | 96 | " |
| 1-E | " | 18 | 85 | |
| 1-A | III | 3 | 99 | Invention |
| 1-B | " | 3 | 99 | " |
| 1-C | " | 5 | 97 | " |
| 1-D | " | 7 | 96 | " |
| 1-E | " | 18 | 85 | |
| 1-A | IV | 4 | 98 | Invention |
| 1-B | " | 4 | 98 | " |
| 1-C | " | 8 | 96 | " |
| 1-D | " | 9 | 95 | " |
| 1-E | " | 20 | 83 | |
| 1-A | V | 16 | 81 | |
| 1-B | " | 18 | 81 | |
| 1-C | " | 20 | 80 | |
| 1-D | " | 22 | 79 | |
| 1-E | " | 27 | 77 | |

EXAMPLE 2

Samples (1-A) and (1-E) as prepared in Example 1 were imagewise exposed and then processed with an automatic developing machine in accordance with the continuous processing procedure described below. The processed samples were evaluated with respect to residual silver and color reproducibility in the same manner as in Example 1.

| Processing Steps | | | | |
|---|---|---|---|---|
| Step | Temp. (°C.) | Time (sec) | Amount of Replenisher* (ml) | Tank Capacity (liter) |
| Color Development | 35 | 45 | 161 | 17 |
| Bleach-fixation | 30–36 | 45 | 215 | 17 |
| Stabilization (1) | 30–37 | 20 | — | 10 |
| Stabilization (2) | 30–37 | 20 | — | 10 |
| Stabilization (3) | 30–37 | 20 | — | 10 |
| Stabilization (4) | 30–37 | 30 | 248 | 10 |
| Drying | 70–85 | 60 | | |

*Amount of replenisher was per $m^2$ of sample being processed.

Stabilization was effected by a cascade system from the stabilization tank (4) to (3) to (2) to (1).

The processing solutions used above had the following compositions.

| | Tank Solution | Replenisher |
|---|---|---|
| Color Developer: | | |
| Water | 800 ml | 800 ml |
| Ethylenediaminetetraacetic Acid | 2.0 g | 2.0 g |
| 5,6-Dihydroxybenzene-1,2,4-trisulfonic Acid | 0.3 g | 0.3 g |
| Triethanolamine | 8.0 g | 8.0 g |
| Sodium Chloride | 1.4 g | — |
| Potassium Carbonate | 25 g | 25 g |
| N-ethyl-N-(β-methanesulfonamidoethyl)-3-methyl-4-aminoaniline Sulfate | 5.0 g | 7.0 g |
| Diethylhydroxylamine | 4.2 g | 6.0 g |
| Brightening Agent (4,4'-diaminostilbene compound) | 2.0 g | 2.5 g |
| Water to make | 1000 ml | 1000 ml |
| pH (25° C.) | 10.05 | 10.45 |
| Bleach-Fixing Solution: | | |
| Tank solution and replenisher were same. | | |
| Water | 400 ml | |
| Ammonium Thiosulfate (70 wt %) | 100 ml | |
| Sodium Sulfite | 17 g | |
| Ammonium Ethylenediaminetetraacetato/Iron(III) | 55 g | |
| Disodium Ethylenediaminetetraacetate | 5 g | |
| Glacial Acetic Acid | 9 g | |
| Water to make | 1000 ml | |
| pH (25° C.) | 5.40 | |
| Stabilizing Solution: | | |
| Tank solution and replenisher were same. | | |
| Formalin (37%) | 0.1 g | |
| Formalin-Sulfite Adduct | 0.7 g | |
| 5-Chloro-2-methyl-4-isothiazolin-3-one | 0.02 g | |
| 2-Methyl-4-isothiazolin-3-one | 0.01 g | |
| Copper Sulfate | 0.005 g | |
| Water to make | 1000 ml | |
| pH (25° C.) | 4.0 | |

During the process, the bleach-fixing solution was regenerated in accordance with the method mentioned below. Specifically, a regenerating agent described below was added to the overflow from the bleach-fixing tank each time the pooled amount of overflow became 20 liters, and the regenerating agent-containing overflow was used as a regenerated replenisher. During the process, regeneration was thus repeated 20 times, and the regeneration percentage rate was 100%.

The composition of the regenerating agent used is shown below. The amount of each component is per liter of overflow.

| Regenerating Agent (2): The components were all solid powders. | |
|---|---|
| Thiosulfate Compound | 0.20 mol |
| Ammonium Ethylenediaminetetraacetato/ Iron(III) Dihydrate | 16.2 g |
| Bisulfite Compound | 0.24 mol |

The thiosulfate compound used included $Na_2S_2O_3$ and $(NH_4)_2S_2O_3$, and the bisulfite compound used included $NaHSO_3$ and $(NH_4)HSO_3$. The proportion of $NH_4+$ was varied as indicated in Table 2 below. Each sample was processed by the above described running procedure, and evaluated as in Example 1. The results obtained are shown in Table 2.

From the results shown in Table 2, it is clearly seen that the residual silver and the color reproducibility of the processed samples were good only when the samples were processed in accordance with the method of the present invention. Where the proportion of $NH_4+$ to all the cations in the regenerating agent used was 75 mol % or more, even better results were obtained.

TABLE 2

| Sample | $NH_4+$ (mol %) in Regenerating Agent | $Na+$ (mol %) in Regenerating Agent | Residual Silver ($\mu g/cm^2$) | Coloration Percentage (%) | Remarks |
|---|---|---|---|---|---|
| 1-A | 50 | 50 | 8 | 95 | Invention |
| " | 75 | 25 | 2 | 99 | " |
| " | 90 | 10 | 1 | 100 | " |
| " | 100 | 0 | 1 | 100 | " |
| 1-E | 50 | 50 | 26 | 77 | |
| " | 75 | 25 | 23 | 79 | |
| " | 90 | 10 | 20 | 81 | |
| " | 100 | 0 | 18 | 83 | |

EXAMPLE 3

Sample (1-A) as prepared in Example 1 was imagewise exposed, and the exposed sample was subjected to a running test with a color paper processing machine. In the test, anyone of the following three color developers (A), (B) and (C) was used. A small-sized processor (No. 1) and a large-sized processor (No. 2) as described below were used for each color developer.

| Processing Step | Temp. (°C.) | Time (sec) | Amount of Replenisher ($ml/m^2$) | Tank Capacity No. 1 (liter) | Tank Capacity No. 2 (liter) |
|---|---|---|---|---|---|
| Color Development | 38 | 45 | 100 | 15 | 500 |
| Bleach-Fixation | 35 | 45 | 215 | 15 | 500 |
| Rinsing (1) | 35 | 20 | — | 8 | 200 |
| Rinsing (2) | 35 | 20 | — | 8 | 200 |
| Rinsing (3) | 35 | 20 | — | 8 | 200 |
| Rinsing (4) | 35 | 30 | 220 | 8 | 200 |
| Drying | 60–80 | 60 | | | |

(Rinsing was effected by a 4-tank cascade system from the rinsing tank (4) to (3) to (2) to (1).)

Compositions of the processing solutions used above were as follows:

| Color Developer (A): | Tank Solution | Replenisher |
|---|---|---|
| Water | 800 ml | 800 ml |
| Benzyl Alcohol | 10 ml | 15 ml |
| Sodium Catechol-3,5-disulfonate | 0.3 g | 0.4 g |
| Ethylenediaminetetraacetic Acid | 1.5 g | 2.0 g |

-continued

| Color Developer (A): | Tank Solution | Replenisher |
|---|---|---|
| Potassium Bromide | 0.025 g | — |
| Triethanolamine | 8.0 g | 12.0 g |
| Sodium Chloride | 3.4 g | — |
| Potassium Carbonate | 25 g | 25 g |
| N-ethyl-N-(β-methanesulfonamidoethyl) -3-methyl-4-aminoaniline Sulfate | 50. g | 9.0 g |
| Sodium Naphthalenesulfonate | — | 0.1 g |
| N,N-diethylhydroxylamine | 4.5 g | 8.0 g |
| Brightening Agent) (WHITEX 4, product of Sumitomo Chemical | 1.0 g | 2.0 g |
| Water to make | 1000 ml | 1000 ml |
| pH (25° C.) | 10.05 | 10.75 |

Color Developer (B)

Color developer (B) was the same as color developer (A), except that the benzyl alcohol concentration in the tank solution was 5 ml/liter and the benzyl alcohol concentration in the replenisher was 8 ml/liter.

Color Developer (C)

Color developer (C) was the same as color developer (A), except that both the tank solution and the replenisher contained no benzyl alcohol.

| Bleach-Fixing Solution: Tank solution and replenisher were same. | |
|---|---|
| Water | 400 ml |
| Ammonium Thiosulfate (70 wt %) | 100 ml |
| Sodium Sulfite | 17 g |
| Ammonium Ethylenediaminetetraacetato/ Iron(III) | 55 g |
| Disodium Ethylenediaminetetraacetate | 5 g |
| Water to make | 1000 ml |
| pH (25° C.) | 5.8 |

Rinsing Water

Tank solution and replenisher were same.

An ion-exchanged water having a calcium concentration and a magnesium concentration of each 3 ppm or less was used as the rinsing water.

Regarding replenishment to the bleach-fixing tank, the overflows of both the No. 1 tank and the No. 2 tank were pooled in a common stock tank, and a regenerating agent having the composition described below was added thereto at the time when the amount of the pooled overflow in the stock tank became 1000 liters. The regenerating agent-containing overflow was used as a regenerated replenisher. The regenerating agent thus used comprised the following components, each of which was per liter of the overflow pooled for regeneration.

| Regenerating Agent: | |
|---|---|
| Ammonium Ethylenediaminetetraacetato/ Iron(III).$2H_2O$ | 15.0 g |
| Ammonium Thiosulfate | 11.2 g |
| Sodium Sulfite | 10 g |
| Ethylenediaminetetraacetic Acid | 1 g |
| Glacial Acetic Acid to make | pH of 5.8 |

The proportion of the solid weight was 72 wt % to the total weight of the regenerating agent.

After the regeneration was repeated 20 times, the wedgewise exposed photographic material sample was processed with the processor No. 1 and the processor No. 2. The regeneration percentage was 100% for both cases.

The amount of silver remaining in the maximum density portion of the processed sample was analyzed by X-ray fluorescence analysis. In order to evaluate the color reproducibility of each sample, the processed sample was retreated (for re-bleaching) with a bleaching solution (CN-16$N_2$, product of Fuji Photo Film), at 25° C. for 4 minutes, whereupon the fluctuation, if any, of the cyan density was measured. The cyan density before re-treatment at the point having a cyan density of 2.2 after re-treatment was measured, and the coloration percentage (%) was obtained from the following formula.

Coloration Percentage (%)
= [(density at the point with $D_R$ = 2.2 before rebleaching treatment)/2.2] × 100

Next, the processed samples were subjected to a xenon lamp irradiation test and irradiated with an 85000 lux-xenon lamp at 25° C. for 5 hours a day, and the test was continued 20 days. After the test, the decrease of the magenta density (light-fading) at the point having a magenta density of 2.0 before the test was measured.

The results obtained are shown in Table 3 below.

TABLE 3

| Exp. No. | Color Developer | Residual Silver (μg/cm) Processor No. 1 | Residual Silver (μg/cm) Processor No. 2 | Cyan Coloration Percentage (%) Processor No. 1 | Cyan Coloration Percentage (%) Processor No. 2 | Magenta Fading Processor No. 1 | Magenta Fading Processor No. 2 |
|---|---|---|---|---|---|---|---|
| 1 | A | 19 | 15 | 79 | 80 | −0.50 | −0.50 |
| 2 | B | 15 | 6 | 80 | 97 | −0.45 | −0.32 |
| 3 | C* | 5 | 5 | 97 | 100 | −0.30 | −0.30 |

*This is an example of the present invention.

Where overflows from two bleach-fixing solutions of different processors (No. 1 and No. 2) were gathered and regenerated with the same regenerating agent to form a regenerated replenisher and the regenerated replenisher was used in accordance with the method of the present invention (Experiment No. 3), the desilverability, color reproducibility and fading resistance were all good. However, In Experiment No. 2, the result was good when the processor No. 2 was used, but unacceptable when the processor No. 1 was used. In Experiment No. 2 using processor No. 1, the regenerate overflow could not be re-used as a replenisher.

In Experiment No. 1 using developer (A), however, where the overflows from each of processor No. 1 and processor No. 2 were segregated and separately regenerated for carrying out the same continuous process, the desilverability, color reproducibility and fading resistance were all good.

EXAMPLE 4

Samples (2), (3) and (4) were prepared in the same manner as in Example 3 (Sample 1-A), except that the silver chloride content (mol %) of each of the silver chlorobromide emulsion layers was varied as indicated below.

| Sample | Blue-Sensitive Layer (mol %) | Green-Sensitive Layer (mol %) | Red-Sensitive Layer (mol %) |
|---|---|---|---|
| 1-A | 99.8 | 99.2 | 99.4 |
| 2 | 95.0 | 95.1 | 95.3 |
| 3 | 90.4 | 90.6 | 90.8 |
| 4 | 84.5 | 84.3 | 84.5 |

The samples were processed with either the running solution (equilibrated solution) of Experiment No. 2 (Developer B) or that of Experiment No. 3 (Developer C) of Example 3. The results obtained after the regeneration was repeated 20 times are shown in Table 4 below for both processors No. 1 and No. 2 as described in Example 3.

TABLE 4

| Exp. No. | Developer | Sample | Residual Silver (μg/cm²) Processor No. 1 | Residual Silver (μg/cm²) Processor No. 2 | Cyan Coloration Percentage (%) Processor No. 1 | Cyan Coloration Percentage (%) Processor No. 2 | Magenta Fading Processor No. 1 | Magenta Fading Processor No. 2 |
|---|---|---|---|---|---|---|---|---|
| 1 | B | 1-A | 15 | 6 | 80 | 97 | −0.45 | −0.32 |
| 2 | B | 2 | 15 | 7 | 80 | 96 | −0.45 | −0.33 |
| 3 | B | 3 | 15 | 7 | 80 | 95 | −0.47 | −0.33 |
| 4 | B | 4 | 16 | 13 | 80 | 90 | −0.47 | −0.33 |
| 5 | C* | 1-A | 5 | 5 | 97 | 100 | −0.30 | −0.30 |
| 6 | C* | 2 | 5 | 5 | 97 | 100 | −0.30 | −0.30 |
| 7 | C* | 3 | 7 | 7 | 93 | 97 | −0.30 | −0.31 |
| 8 | C* | 4 | 8 | 8 | 90 | 93 | −0.31 | −0.31 |

*These are samples of the present invention.

From the results in Table 4 above, it is clearly seen that the samples processed by the method of the present invention exhibited good desilverability, color reproducibility and fading resistance. In particular, better results were obtained in processing samples (1-A) and (2) each having high silver chloride content emulsions.

EXAMPLE 5

Both surfaces of a paper support were coated with polyethylene, one surface of which was surface-treated by corona-discharging. The plural layers described below were formed on the treated surface of the support to prepare a multilayer color photographic paper sample. Coating compositions were prepared as described below.

Preparation of Coating Composition for First Layer 150 cc of ethyl acetate, 1.0 cc of solvent (Solv-3) and 3.0 cc of solvent (Solv-4) were added to 60.0 g of yellow coupler (ExY) and 28.0 g of anti-fading agent (Cpd-1) and dissolved. The resulting solution was added to 450 cc of an aqueous 10 wt % gelatin solution containing sodium dodecylbenzenesulfonate and homogenized with an ultrasonic homogenizer. The resulting dispersion was blended with 420 g of a chlorobromide emulsion (silver bromide content: 0.7 mol %) containing the blue-sensitizing dye described below, to prepare a coating composition for the first layer.

Other coating compositions for the second to seventh layers were also prepared in the same manner as above. As a gelatin hardening agent, 1,2-bis(vinylsulfonyl)ethane was used for each layer.

The following color sensitizing dyes were added to the respective layers.

Blue-sensitive Emulsion Layer

Anhydro-5,5'-dichloro-3,3'-disulfoethylthiacyanine hydroxide

Green-sensitive Emulsion Layer

Anhydro-9-ethyl-5,5'-diphenyl-3,3'-disulfoethyloxacarbocyanine hydroxide

Red-sensitive Emulsion Layer 3,3'-Diethyl-5-methoxy-9,11-neopentylthiadicarbocyanine iodide As a stabilize for each layer, a mixture of the following compounds (1), (2) and (3) was used in a proportion of 7/2/1 by mol.

(1) 1-(2-Acetamino-phenyl)-5-mercaptotetrazole
(2) 1-Phenyl-5-mercaptotetrazole
(3) 1-(P-methoxyphenyl)-5-mercaptotetrazole As anti-irradiation dyes, the following compounds were used.

[3-Carboxy-5-hydroxy-4-(3-(3-carboxy-5-oxo-1-(2,5-bisulfonatophenyl)-2-pyrazolin-4-ylidene)-1-propenyl)-1-pyrazolyl]benzene-2,5-disulfonate disodium salt N,N'-(4,8-dihydroxy-9,10-dioxo-3,7-disulfonatoanthracene-1,5-diyl)bis(aminomethanesulfonate) tetrasodium salt [3-Cyano-5-hydroxy-4-(3-(3-cyano-5-oxo-1-(4-sulfonatophenyl)-2-pyrazolin-4-ylidene)-1-pentanyl)-1-pyrazolyl]benzene-4-sulfonate sodium salt

Layer Constitution

Components constituting the respective layers are shown below. The number indicates the amount coated (as g/m$^2$). The coated amount of silver halide emulsion is expressed in terms of the silver content.

Support

A paper support both surfaces of which were coated with polyethylene was used as a support. The emulsion layer side of the polyethylene-coated support was treated by corona-discharge prior to coating.

| | |
|---|---|
| First Layer (Blue-Sensitive Layer): | |
| The above described Silver Chlorobromide Emulsion (AgBr 0.7 mol %, cubic grains having a mean grain size of 0.9 μm) | 0.35 (as silver) |
| Gelatin | 1.80 |
| Yellow Coupler (ExY) | 0.60 |
| Anti-fading Agent (Cpd-1) | 0.28 |
| Solvent (Solv-3) | 0.01 |
| Solvent (Solv-4) | 0.03 |
| Second Layer (Color Mixing Preventing Layer): | |
| Gelatin | 0.80 |
| Color Mixing Preventing Agent (Cpd-2) | 0.055 |
| Solvent (Solv-1) | 0.03 |
| Solvent (Solv-2) | 0.15 |
| Third Layer (Green-Sensitive Layer): | |
| Above described Silver Chlorobromide Emulsion (AgBr 0.7 mol %, cubic grains having a mean grain size of 0.45 μm) | 0.25 |
| Gelatin | 1.86 |
| Magenta Coupler (ExM) | 0.27 |
| Anti-fading Agent (Cpd-3) | 0.17 |
| Anti-fading Agent (Cpd-4) | 0.10 |
| Solvent (Solv-1) | 0.2 |
| Solvent (Solv-2) | 0.03 |
| Fourth Layer (Color Mixing Preventing Layer): | |
| Gelatin | 1.70 |
| Color Mixing Preventing Agent (Cpd-2) | 0.065 |
| Ultraviolet Absorbent (UV-1) | 0.45 |
| Ultraviolet Absorbent (UV-2) | 0.23 |
| Solvent (Solv-1) | 0.05 |
| Solvent (Solv-2) | 0.05 |
| Fifth Layer (Red-Sensitive Layer): | |
| Above-mentioned Silver Chlorobromide Emulsion (AgBr 4 mol %, cubic grains having a mean grain size of 0.5 μm) | 0.25 |
| Gelatin | 1.80 |
| Cyan Coupler (ExC-1) | 0.26 |
| Cyan Coupler (ExC-2) | 0.12 |
| Anti-fading Agent (Cpd-1) | 0.20 |
| Solvent (Solv-1) | 0.16 |
| Solvent (Solv-2) | 0.09 |
| Coloring Accelerator (Cpd-5) | 0.15 |
| Sixth Layer (Ultraviolet Absorbing Layer): | |
| Gelatin | 0.70 |
| Ultraviolet Absorbent (UV-1) | 0.26 |
| Ultraviolet Absorbent (UV-2) | 0.07 |
| Solvent (Solv-1) | 0.30 |
| Solvent (Solv-2) | 0.09 |
| Seventh Layer (Protective Layer): | |
| Gelatin | 1.07 |

Compounds used in preparing the above-described sample are indicated below.

| | |
|---|---|
| (Cpd-1) Anti-fading Agent: $-(CH_2-C(CONHC_4H_9(n))H)_n-$ | (mean molecular weight: 80,000) |

(Cpd-2) Anti-fading Agent 2,5-Di-tert-octylhydroquinone

(Cpd-3) Anti-fading Agent 7,7'-Dihydroxy-4,4,4',4'-tetramethyl-2,2'-spirochroman

(Cpd-4) Anti-fading Agent

N-(4-dodecyloxyphenyl)-morpholine

(Cpd-5) Coloring Accelerator

P-(p-toluenesulfonamido)phenyl-dodecane (Solv-1) Solvent

Di(2-ethylhexyl) Phthalate (Solv-2) Solvent

Dibutyl Phthalate (Solv-3) Solvent

Di(i-nonyl) Phthalate (Solv-4) Solvent

N,N-diethylcarbonamido-methoxy-2,4-di-t-amylbenzene (UV-1) Ultraviolet Absorbent 2-(2-Hydroxy-3,5-di-tert-amylphenyl)benzotriazole (UV-2) Ultraviolet Absorbent 2-(2-Hydroxy-3,5-di-tert-butylphenyl)benzotriazole (ExY) Yellow Coupler:

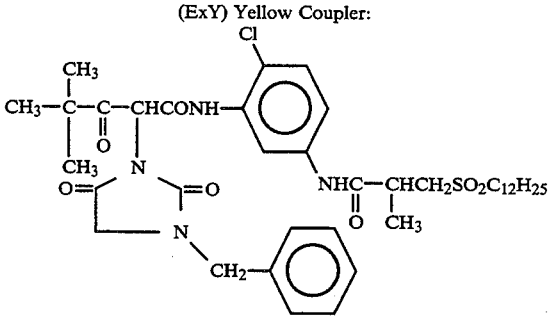

(ExM) Magenta Coupler:

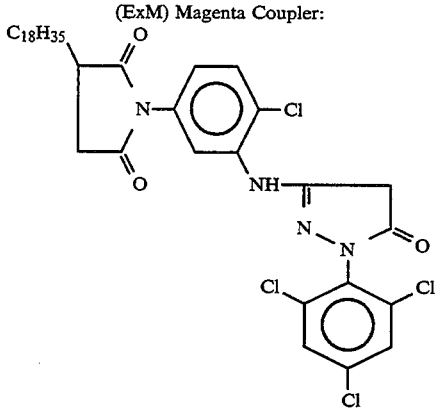

-continued (ExC) Cyan Couplers:

ExC-1:

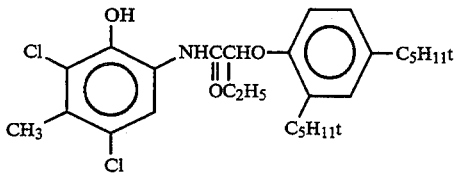

ExC-2:

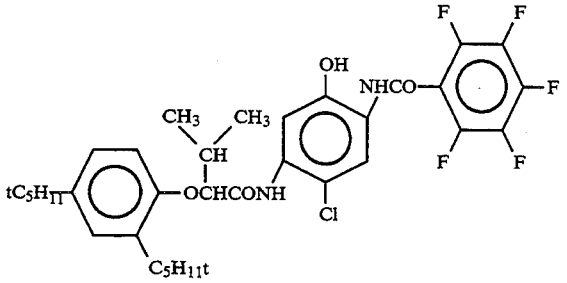

The sample thus prepared was coded as sample (2A). Other samples (2B) to (2F) were prepared in the same manner as above, except that the magenta coupler and the amount of silver in each emulsion layer were varied as indicated in the following Table.

| Sample | Magenta Coupler | Silver Coated ($g/m^2$) 1st layer | 3rd layer | 5th layer | total |
|---|---|---|---|---|---|
| 2A | ExM | 0.35 | 0.25 | 0.25 | 0.85 |
| 2B | M-1 | 0.35 | 0.25 | 0.25 | 0.85 |
| 2C | M-2 | 0.35 | 0.25 | 0.25 | 0.85 |
| 2D | M-1 | 0.35 | 0.15 | 0.25 | 0.75 |
| 2E | M-1 | 0.25 | 0.15 | 0.20 | 0.60 |
| 2F | M-1 | 0.25 | 0.15 | 0.15 | 0.55 |

M-1

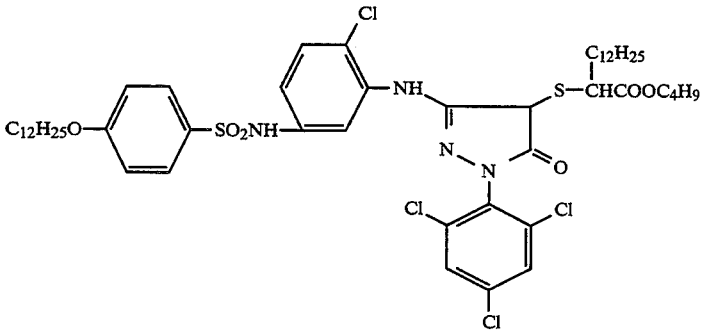

-continued

M-2

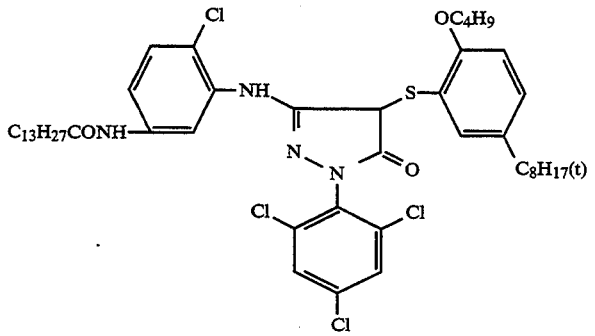

These samples were imagewise exposed and then processed in accordance with the continuous processing procedure described below (running test), using two paper processors No. 3 and No. 4. Accordingly, a color image was formed on each sample.

| Step | Temp. (°C.) | Time (sec) | Amount of Replenisher (*) (ml) | Tank Capacity No. 3 (liter) | Tank Capacity No. 4 (liter) |
|---|---|---|---|---|---|
| Color Development | 35 | 45 | 161 | 17 | 450 |
| Bleach-fixation | 30–36 | 45 | 215 | 17 | 450 |
| Stabilization (1) | 30–37 | 20 | — | 10 | 200 |
| Stabilization (2) | 30–37 | 20 | — | 10 | 200 |
| Stabilization (3) | 30–37 | 20 | — | 10 | 200 |
| Stabilization (4) | 30–37 | 30 | 248 | 10 | 200 |
| Drying | 70–85 | 60 | | | |

(*)Amount of replenisher was per $m^2$ of sample being processed.

Stabilization was effected by a 4-tank cascade system from the stabilization bath (4) to (3) to (2) to (1).

The processing solutions had the following compositions.

| Color Developer (D): | Tank Solution | Replenisher |
|---|---|---|
| Water | 800 ml | 800 ml |
| Benzyl Alcohol | 5.0 ml | 8.0 ml |
| Ethylenediaminetetraacetic Acid | 2.0 g | 2.0 g |
| 5,6-Dihydroxybenzene-1,2,4-trisulfonic Acid | 0.3 g | 0.3 g |
| Triethanolamine | 8.0 g | 8.0 g |
| Sodium Chloride | 1.4 g | — |
| Potassium Carbonate | 25 g | 25 g |
| N-ethyl-N-(β-methanesulfonamidoethyl)-3-methyl-4-aminoaniline Sulfate | 5.0 g | 7.0 g |
| Diethylhydroxylamine | 4.2 g | 6.0 g |
| Brightening Agent (4,4-diaminostilbene compound) | 2.0 g | 2.5 g |
| Water to make | 1000 ml | 1000 ml |
| pH (25° C.) | 10.05 | 10.45 |

Color Developer (E)

Color developer (E) was the same as color developer (D), except that no benzyl alcohol was added to both the tank solution and the replenisher.

| Bleach-fixing Solution: | |
|---|---|
| Tank solution and replenisher were same. | |
| Water | 400 ml |
| Ammonium Thiosulfate (70 wt %) | 100 ml |
| Sodium Sulfite | 17 g |
| Ammonium Ethylenediaminetetraacetato/Iron(III) | 55 g |
| Disodium Ethylenediaminetetraacetate | 5 g |
| Glacial Acetic Acid | 9 g |
| Water to make | 1000 ml |
| pH (25° C.) | 5.40 |
| **Stabilizing Solution:** | |
| Tank solution and replenisher were same. | |
| Formalin (37%) | 0.1 g |
| Formalin-Sulfite Adduct | 0.7 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Water to make | 1000 ml |
| pH (25° C.) | 4.0 |

The overflows from both bleach-fixing tanks were collected and regenerated 20 times in the same manner as in Example 1, using a regenerating agent comprising the components described below, and the regenerated solution was used as a replenisher to the bleach-fixing tanks. The amounts of the respective components constituting the regenerating agent are per liter of overflow. The regeneration percentage was 100%. The proportion of the solid weight to the total weight of the regenerating agent was 72 wt %.

| Regenerating agent | |
|---|---|
| Ammonium Ethylenediaminetetraacetato/iron(III) | 15 g |
| Ethylenediaminetetraacetic Acid | 2 g |
| Sodium Sulfite | 8.0 g |
| Ammonium Thiosulfate (70 wt %) | 20 ml |
| Glacial Acetic Acid to make | pH of 5.40 |

The processed samples were evaluated in the same manner as in Example 1, with respect to the desilvering property, color reproducibility and magenta color fading resistance to light. The results obtained are shown in Table 6 below.

TABLE 6

| Exp. No. | Sample | Developer | Residual Silver ($\mu g/cm^2$) Processor No. 3 | Residual Silver ($\mu g/cm^2$) Processor No. 4 | Cyan Coloration Percentage (%) Processor No. 3 | Cyan Coloration Percentage (%) Processor No. 4 | Magenta Fading Processor No. 3 | Magenta Fading Processor No. 4 |
|---|---|---|---|---|---|---|---|---|
| 1 | 2A | D | 15 | 13 | 83 | 97 | −0.40 | −0.33 |
| 2 | 2B | D | 15 | 13 | 83 | 96 | −0.47 | −0.33 |
| 3 | 2C | D | 15 | 12 | 83 | 95 | −0.47 | −0.33 |
| 4 | 2D | D | 14 | 11 | 84 | 90 | −0.47 | −0.33 |
| 5 | 2E | D | 13 | 7 | 86 | 100 | −0.47 | −0.30 |
| 6 | 2F | D | 12 | 6 | 87 | 100 | −0.47 | −0.30 |
| 7 | 2A | E* | 6 | 5 | 93 | 97 | −0.25 | −0.25 |
| 8 | 2B | E* | 6 | 5 | 97 | 99 | −0.20 | −0.20 |
| 9 | 2C | E* | 6 | 5 | 88 | 100 | −0.20 | −0.19 |
| 10 | 2D | E* | 3 | 3 | 100 | 100 | −0.19 | −0.18 |
| 11 | 2E | E* | 2 | 2 | 100 | 100 | −0.19 | −0.18 |
| 12 | 2F | E* | 2 | 2 | 100 | 100 | −0.19 | −0.18 |

(*)These are samples of the present invention.

As clearly seen from the results in Table 6 above, the samples of the present invention (Nos. 7 to 12) as processed in accordance with the method of the invention provided improved desilvering property, color reproducibility and magenta-fading resistance. In particular, those samples containing a preferred magenta coupler (Nos. 10 to 12) provided even better results with respect to color reproducibility and magenta-fading resistance. In addition, when the silver content in the material is reduced to 0.75 $g/m^2$ or less, especially 0.60 $g/m^2$ or less, the photographic characteristics of the material were further improved.

EXAMPLE 6

Other samples were prepared in the same manner as Sample (2E) of Example 5, except that magenta couplers (M-3), (M-4), (M-5) or (M-6) shown below were used in place of magenta coupler (M-1). These were processed and evaluated in the same manner as in Example 5, and the same good results were obtained.

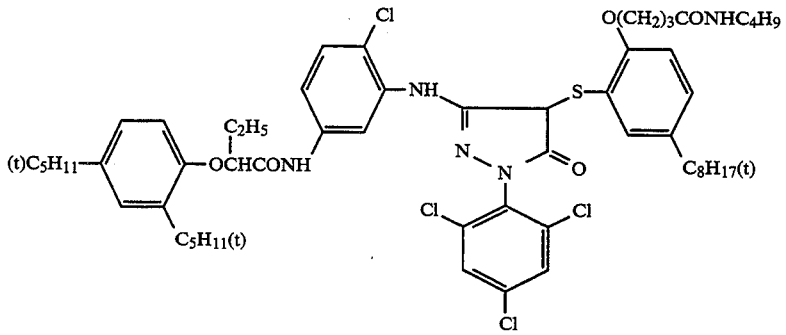

M-3

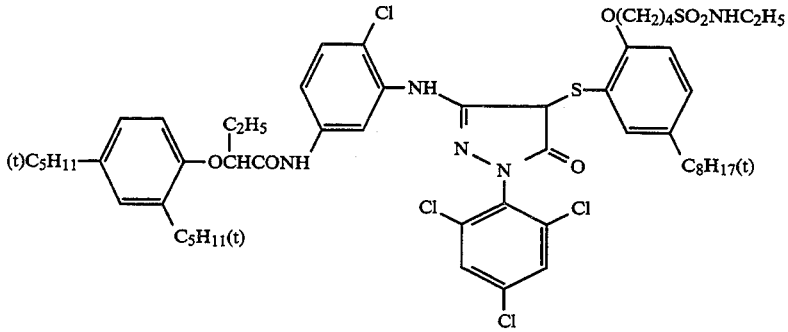

M-4

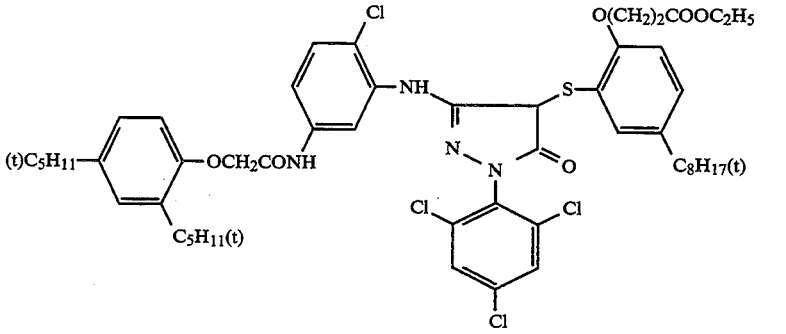

M-5

-continued

M-6

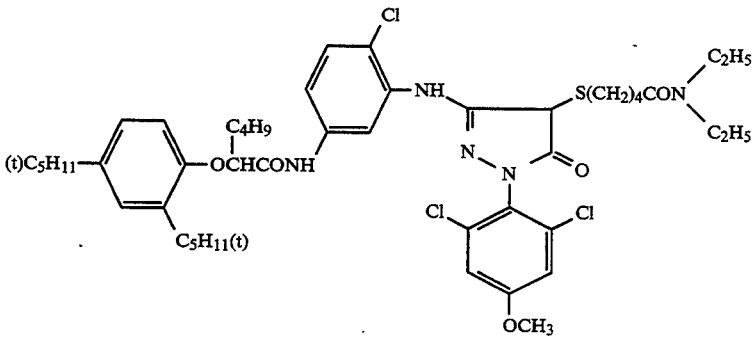

EXAMPLE 7

Sample (1-A) prepared as in Example 1 was imagewise exposed and then continuously processed with an automatic developing machine in accordance with the continuous processing procedure described below. Apart from this, sample (1-A) was wedgewise exposed and then processed in the same manner. The processed sample was stored under conditions of 80° C. and 70% RH for 2 weeks. Fading of the yellow density (ΔDmax BL) of the stored sample was obtained from the following formula:

| |
|---|
| ΔDmax BL = (yellow density at the maximum density part of the non-stored sample) − (yellow density at the maximum density part of the stored sample) |

| Step | Time (sec) | Processing Steps Temp. (°C.) | Amount of Replenisher (*) (ml) | Tank Capacity (liter) |
|---|---|---|---|---|
| Color Development | 45 | 38 | 98 | 500 |
| Bleach-fixation | 45 | 35 | 100 | 500 |
| Rinsing (1) | 20 | 35 | — | 200 |
| Rinsing (2) | 20 | 35 | — | 200 |
| Rinsing (3) | 20 | 35 | — | 200 |
| Rinsing (4) | 30 | 35 | 220 | 200 |
| Drying | 1 min | 60–80 | | |

(*)Amount of replenisher was per $m^2$ of sample being processed.

Rinsing was effected by a cascade rinsing system from (4) to (3) to (2) to (1). The amount of carryover of the developer to the bleach-fixing step and that of carryover of the bleach-fixing solution to the rinsing step each were 60 ml per $m^2$ of the sample being processed. The crossover time was 10 seconds for each transition period, and this time was included in the processing time for the previous step. The processing solutions used above had the following compositions.

| | Mother Solution (g) | Replenisher (g) |
|---|---|---|
| Color Developer: | | |
| Triethanolamine | 5.8 | 11.6 |
| Polyvinyl Alcohol (saponification degree 74%) | 1.0 | 1.0 |
| 1-Hydroxyethylidene-1, 1-diphosphonic Acid Pentasodium | 0.3 | 0.6 |
| Diethylenetriaminepentaacetate Pentasodium Nitrilotris(methylene-phosphonate) | 1.5 | 3.0 |
| Potassium Chloride | 2.3 | — |
| Potassium Bromide | 0.01 | — |
| Disodium N,N-bis(sulfonatoethyl)-hydroxylamine | 3.5 | 7.0 |
| N-ethyl-N-(β-methanesulfonamidoethyl)-3-methyl-4-aminoaniline Sulfate | 4.75 | 9.5 |
| Brightening Agent (WHITEX 4, product of Sumitomo Chemical) | 1.25 | 2.5 |
| Potassium Carbonate | 26.0 | 26.0 |
| Water to make | 1.0 liter | 1.0 liter |
| pH | 10.05 | 10.60 |
| Bleach-Fixing Solution: | | |
| Ammonium Thiosulfate Aqueous Solution (700 g/liter) | 110 ml | 140 ml |
| Ammonium Ethylenediaminetetraacetato/Iron(III) Dihydrate | 40.0 | 50.0 |
| Ammonium Sulfite | 25.0 | 40.0 |
| Acetic Acid to adjust | pH of 6.00 | pH of 5.70 |
| Water to make | 1.0 liter | 1.0 liter |

Rinsing Water

An ion-exchanged water having a calcium ion concentration and a magnesium ion concentration of each 3 ppm or less was used as the rinsing water.

During the process, the bleach-fixing solution was regenerated in accordance with the method described below. Specifically, when the amount of the pooled overflow reached 200 liters, a part of the pooled overflow was removed, and any one of regenerating agents (3-1) to (3-5) described below and water were added to the remaining overflow to make a total of 200 liters. The thus regenerated solution was used as a regenerated replenisher. During the process, regeneration was thus repeated 15 times. The results obtained are shown in Table 7 below.

As is indicated in Table 7, the concentration of the ethylenediaminetetraacetato/Fe(III) (relating to bleaching capacity) in the regenerated solution was the same in all cases using one of the regenerating agents (3-1) to (3-5) after regeneration was completed 15 times.

| Regenerating Agent (3-1): | |
|---|---|
| Ammonium thiosulfate | 29.1 g |
| Ammonium Ethylenediaminetetraacetato/Iron(III) Dihydrate | 16.2 g |

-continued

| | |
|---|---|
| Ammonium Sulfite (96 wt %) | 33.3 g |
| Acetic Acid | 18.2 ml |

The amounts of the components constituting the regenerating agent was per x liter of overflow, x being indicated in Table 7 below. The proportion of the solid weight to the total weight of the regenerating agent was 80.5 wt %.

Where the regeneration percentage was 70% or more, depression of the yellow density was small and the processed samples yielded good results.

TABLE 7

| | Regeneration Percentage (%) | x | Concentration of ammonium ethylenediamine-tetraacetato/Fe(III) (g/liter) in 15-time regenerated solution | ΔDmax BL |
|---|---|---|---|---|
| 3-1 | 100 | 1.00 | 45 | 0.13 |
| 3-2 | 90 | 0.97 | 45 | 0.14 |
| 3-3 | 80 | 0.93 | 45 | 0.16 |
| 3-4 | 70 | 0.90 | 45 | 0.18 |
| 3-5 | 60 | 0.86 | 45 | 0.30 |

In accordance with the processing method of the present invention, repeated reuse of the used bleach-fixing solution as a replenisher to the bleach-fixing bath is practically accomplished without interfering with the desilvering property and color reproducibility of the processing solution. Accordingly, silver halide color photographic materials are processed by the method of the present invention to provide excellent photographic images having good storage stability. Thus, the amount of the waste drained from a processor can be noticeably reduced. It is also possible that the amount of waste is 0. Further, these effects can be obtained without the deterioration of the storage stability of yellow dyes formed in the processed photographic material. Furthermore, according to the method of the present invention, the regeneration of bleach-fixing solution can be carried out without removing unnecessary components (e.g., silver) from the overflow solution such as the conventional means of recovering silver ion by electrolysis.

While the invention has been described in detail and with reference to specific embodiments thereof, it will be apparent to one skilled in the art that various changes and modifications can be made therein without departing from the spirit and scope thereof.

What is claimed is:

1. A method of processing an imagewise exposed silver halide color photographic material, said photographic material comprising a support having thereon a photosensitive silver halide emulsion layer containing a silver halide emulsion having a silver chloride content of at least 80 mol %, comprising the steps of color developing the photographic material in a color developing solution, and then bleach-fixing in a bleach-fixing solution, further comprising replenishing the bleach-fixing solution by adding thereto a bleach-fixing replenisher, said bleach-fixing replenisher comprising (a) a regenerating agent containing ammonium ions and (b) overflow solution from the bleach-fixing tank, wherein the solids content of the regenerating agent is at least 70 wt % of the total weight of the regenerating agent, the ammonium ion content is 75 mol % or more of the total cation content of the regenerating agent, and 90% or more of the overflow solution is returned to the bleach-fixing solution.

2. A method as in claim 1, wherein the solids content of the regenerating agent is at least 80 wt % of the total weight of the regenerating agent.

3. A method as in claim 1, wherein the solids content of the regenerating agent is 100 wt % of the total weight of the regenerating agent.

4. A method as in claim 1, wherein the solids constituting the regenerating agent are in the form of a powder or granular substance.

5. A method as in claim 1, wherein the ammonium ion content is 90 mol % or more of the total cation content of the regenerating agent.

6. A method as in claim 1, further comprising aerating the collected overflow from the bleach-fixing tank.

7. A method as in claim 1, wherein the amount of replenisher added to the bleach-fixing solution is from 30 ml to 500 ml per $m^2$ of the photographic material being processed.

8. A method as in claim 1, wherein the silver halide emulsion of the photosensitive silver halide emulsion layer has a silver chloride content of from 90 to 100 mol %.

9. A method as in claim 1, wherein the silver halide emulsion of the photosensitive silver halide emulsion layer has a silver chloride content of from 96 to 99.9 mol %.

10. A method as in claim 1, wherein the bleach-fixing replenisher consists of the collected overflow from the bleach-fixing tank and the regenerating agent, and no replenisher other than the bleach-fixing replenisher is added to the bleach-fixing solution.

11. A method as in claim 1, wherein the regenerating agent contains an oxidizing agent, a fixing agent and a preservative.

12. A method as in claim 1, wherein the photosensitive silver halide emulsion layer contains a cyan coupler represented by formula (C):

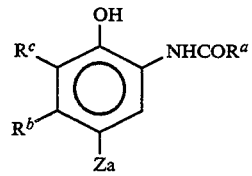

(C)

wherein $R^a$ represents an alkyl group, a cycloalkyl group, an aryl group, an amino group, or a heterocyclic group;

$R^b$ represents an acylamino group, or an alkyl group having two or more carbon atoms;

$R^c$ represents a hydrogen atom, a halogen atom, an alkyl group or an alkoxy group, and Rc may be bonded to Rb to form a ring;

Za represents a hydrogen atom, a halogen atom, or a group which is released upon reaction with an oxidation product of an aromatic primary amine color developing agent.

13. A method as in claim 12, wherein the cyan coupler is contained in an amount of from $1\times10^{-4}$ to $1\times10^{-2}$ mol per $m^2$ of the photographic material.

14. A method as in claim 1, wherein the color developing solution contains benzyl alcohol in an amount of 2.0 ml/liter or less.

15. A method as in claim 1, wherein the color developing solution contains no benzyl alcohol.

* * * * *